US010008780B2

(12) United States Patent
Hosono et al.

(10) Patent No.: US 10,008,780 B2
(45) Date of Patent: Jun. 26, 2018

(54) MICROSTRIP ANTENNA

(71) Applicant: FUJIKURA LTD., Tokyo (JP)

(72) Inventors: Ryohei Hosono, Sakura (JP); Ning Guan, Sakura (JP); Yusuke Nakatani, Sakura (JP)

(73) Assignee: FUJIKURA LTD., Tokyo (JP)

( * ) Notice: Subject to any disclaimer, the term of this patent is extended or adjusted under 35 U.S.C. 154(b) by 182 days.

(21) Appl. No.: 15/121,511

(22) PCT Filed: Dec. 10, 2014

(86) PCT No.: PCT/JP2014/082688

§ 371 (c)(1),
(2) Date: Aug. 25, 2016

(87) PCT Pub. No.: WO2015/133033

PCT Pub. Date: Sep. 11, 2015

(65) Prior Publication Data

US 2016/0365643 A1 Dec. 15, 2016

(30) Foreign Application Priority Data

Mar. 3, 2014 (JP) ..... 2014-040915

(51) Int. Cl.

| | |
|---|---|
| ***H01Q 13/08*** | (2006.01) |
| ***H01P 5/107*** | (2006.01) |
| ***H01Q 1/38*** | (2006.01) |
| ***H01Q 1/48*** | (2006.01) |
| *H01P 1/203* | (2006.01) |

(52) U.S. Cl.

CPC ..... *H01Q 13/08* (2013.01); *H01P 5/107* (2013.01); *H01Q 1/38* (2013.01); *H01Q 1/48* (2013.01); *H01P 1/2039* (2013.01)

(58) Field of Classification Search

CPC ..... H01Q 13/08; H01Q 5/107; H01Q 1/38; H01Q 1/48

USPC ..... 343/700 MS

See application file for complete search history.

(56) References Cited

U.S. PATENT DOCUMENTS 4,291,312 A 9/1981 Kaloi

FOREIGN PATENT DOCUMENTS

| | | |
|---|---|---|
| JP | 4-157905 A | 5/1992 |
| JP | 9-246852 A | 9/1997 |
| JP | 2001-111336 A | 4/2001 |
| JP | 2009-188683 A | 8/2009 |

(Continued)

OTHER PUBLICATIONS

International Search Report dated Feb. 24, 2015, issued in counterpart International Application No. PCT/JP2014/082688 (2 pages).

(Continued)

*Primary Examiner* — Andrea Lindgren Baltzell

(74) *Attorney, Agent, or Firm* — Westerman, Hattori, Daniels & Adrian, LLP

(57) ABSTRACT

An antenna (1) of the present invention includes: a dielectric substrate (11); an antenna conductor (12) including: a power feeding line (12*a*) that extends in a first direction; and a stub (12*b*); and a ground conductor (13). The antenna (1) further includes: a first parasitic element (12*d*) facing a first side of the stub (12*b*) which first side is on a side of a direction opposite to the first direction; and a second parasitic element (12*e*) facing a second side of the stub (12*b*) which second side is on the first direction side.

10 Claims, 28 Drawing Sheets

(56) References Cited

FOREIGN PATENT DOCUMENTS

JP 2011-223050 A 11/2011

OTHER PUBLICATIONS

Notice of Reasons for Refusal dated Feb. 17, 2015, issued in counterpart Japanese Patent Application No. 2014-040915 in Japanese (2 pages).
Notice of Allowance dated Jul. 7, 2015, issued in counterpart Japanese Patent Application No. 2014-040915 in Japanese (1 page).

MICROSTRIP ANTENNA

TECHNICAL FIELD

The present invention relates to a microstrip antenna including a comb-line antenna conductor.

BACKGROUND ART

In line with advancement of wireless communications in terms of increased speed and capacity and advancement of wireless devices in terms of reduced size, there is an increasing demand for an antenna that operates in a millimeter wave band (not lower than 30 GHz and not higher than 300 GHz). Since a higher frequency causes a greater conductor loss and a greater dielectric loss, it is important that an antenna that operates in a millimeter wave band be designed so that a conductor loss and a dielectric loss are reduced.

As a transmission line for transmitting an electromagnetic wave in a millimeter wave band, a waveguide is suitably used. As an antenna for radiating an electromagnetic wave in a millimeter wave band, a comb-line microstrip antenna is suitably used.

Patent Literature 1 discloses a comb-line microstrip antenna. Patent Literature 2 discloses an antenna in which a waveguide is attached to a comb-line microstrip antenna.

CITATION LIST

Patent Literatures

[Patent Literature 1]

Japanese Patent Application Publication, Tokukai, No. 2009-188683 (publication date: Aug. 20, 2009)

[Patent Literature 2]

Japanese Patent Application Publication, Tokukai, No. 2011-223050 (publication date: Nov. 4, 2011)

SUMMARY OF INVENTION

Technical Problem

An antenna is generally required to exhibit an excellent reflection characteristic and an excellent radiation characteristic. An antenna is required to exhibit a reflection characteristic of, for example, having a reflection coefficient which is not more than −10 dB in an operation band. Further, an antenna is required to exhibit a radiation characteristic of, for example, having (i) a maximum gain which is not less than 10 dBi and (ii) a side lobe level which is not less than 10 dB.

The antennas disclosed in Patent Literatures 1 and 2 still have room for improvement in structure for the purpose of obtaining an excellent reflection characteristic and an excellent radiation characteristic.

Inventors of the present invention made an invention of a structure of an antenna that makes it possible to obtain an ever-more-excellent reflection characteristic and an ever-more-excellent radiation characteristic, and an applicant of the present application filed this invention (Japanese Patent Application No.: Tokugan, No. 2013-170662 (filing date: Aug. 20, 2013)) prior to filing of the present application. The antenna in accordance with the invention of the prior application exhibits an ever-more-excellent reflection characteristic and an ever-more-excellent radiation characteristic in a specific band. Note, however, that the antenna in accordance with the invention of the prior application still have room for improvement in structure for the purpose of expanding a width of a band in which an ever-more-excellent reflection characteristic and an ever-more-excellent radiation characteristic are exhibited.

An object of the present invention is to allow a microstrip antenna including a comb-line antenna conductor to expand a width of a band in which an ever-more-excellent reflection characteristic and an ever-more-excellent radiation characteristic are exhibited.

Solution to Problem

In order to attain the object, a microstrip antenna in accordance with the present invention includes: a dielectric substrate; a comb-line antenna conductor provided on a front surface of the dielectric substrate and including: a power feeding line that extends in a first direction; and a stub that extends from the power feeding line in a second direction orthogonal to the first direction; a ground conductor provided on a back surface of the dielectric substrate; a first parasitic element provided on the front surface of the dielectric substrate and facing a first side of the stub which first side is on a side of a direction opposite to the first direction; and a second parasitic element provided on the front surface of the dielectric substrate and facing a second side of the stub which second side is on the first direction side.

According to the arrangement, functions of the first parasitic element and the second parasitic element make it possible to expand a width of a band in which an ever-more-excellent reflection characteristic and an ever-more-excellent radiation characteristic are exhibited.

Advantageous Effects of Invention

The present invention makes it possible to provide an antenna that allows expansion of a width of a band in which an ever-more-excellent reflection characteristic and an ever-more-excellent radiation characteristic are exhibited.

BRIEF DESCRIPTION OF DRAWINGS (a) of FIG. 1 is a plan view of an antenna in accordance with an embodiment. (b) of FIG. 1 is a side view of the antenna. (c) of FIG. 1 is a bottom view of the antenna. (d) of FIG. 1 is an elevation view of the antenna.

Figure 5:
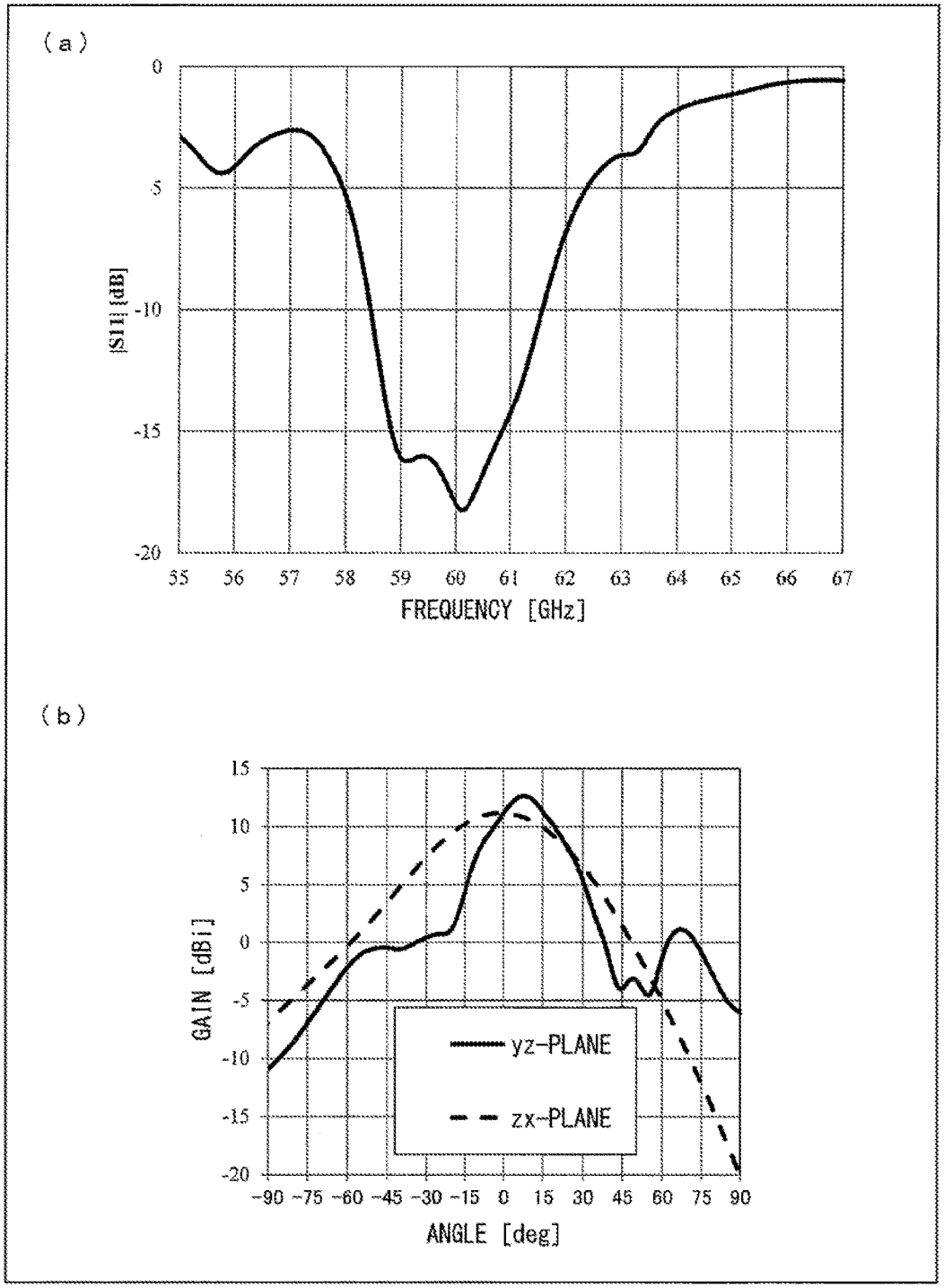

(a) of FIG. 5 is a graph showing a reflection characteristic of the antenna in accordance with the Example. (b) of FIG. 5 is graphs each showing a radiation characteristic of the antenna in accordance with the Example.

Figure 6:
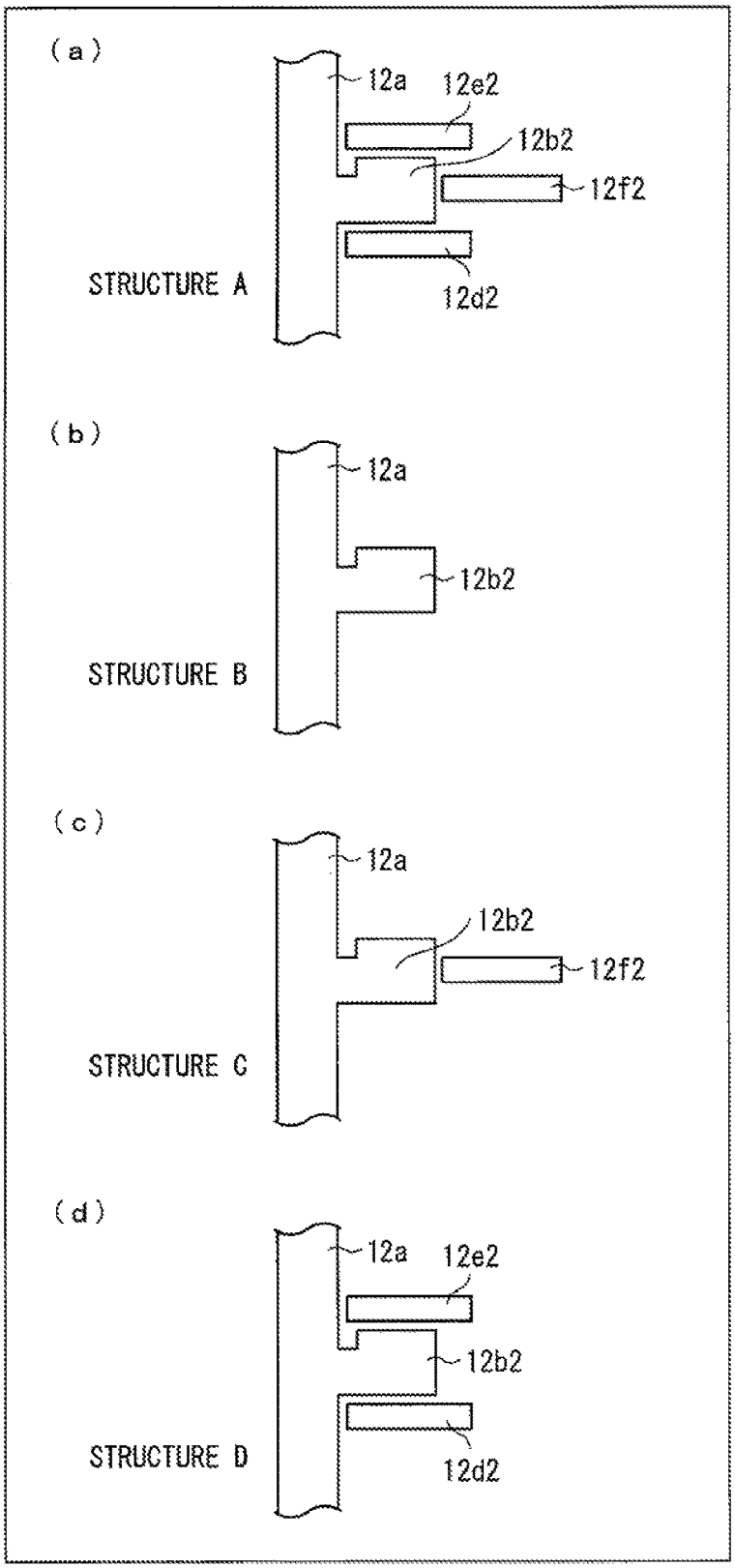

(a) of FIG. 6 is a plan view of the antenna in accordance with the Example. (b) and (c) of FIG. 6 are plan views of antennas in accordance with Comparative Examples. (d) of FIG. 6 is a plan view of an antenna in accordance with another Example. The antennas illustrated in (b) through (d) of FIG. 6 are each obtained by omitting a part or all of a parasitic element included in an antenna element of the antenna illustrated in (a) of FIG. 6.

Figure 7:
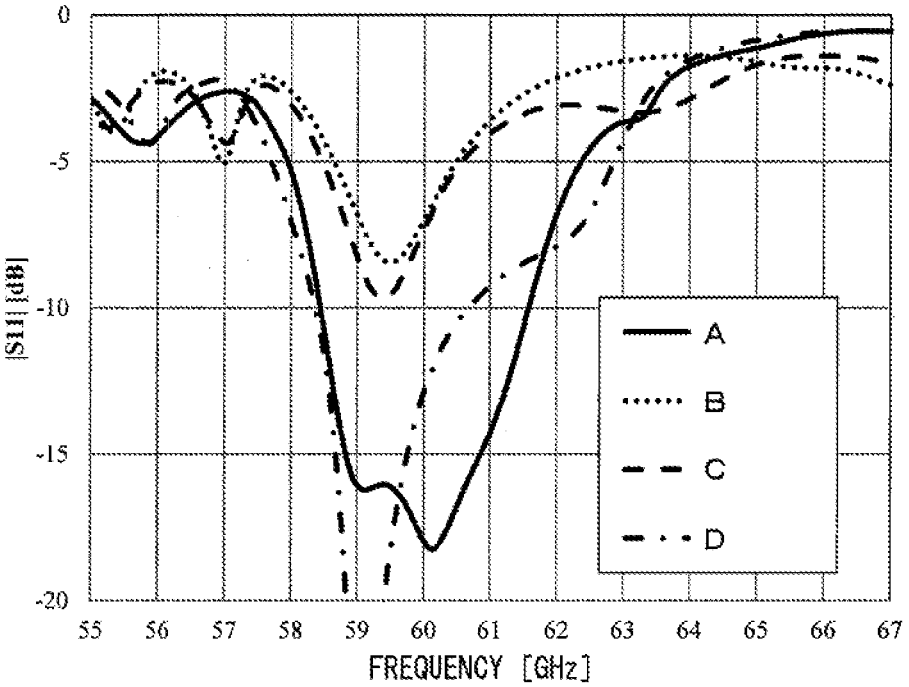

FIG. 7 is graphs showing respective reflection characteristics of the antennas illustrated in (a) through (d) of FIG. 6.

Figure 8:
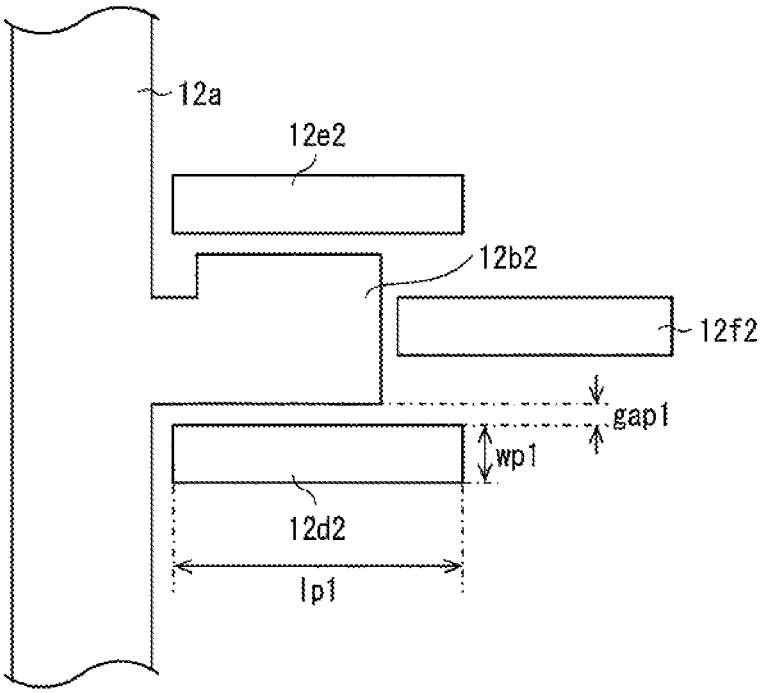

FIG. 8 is a plan view of the antenna in accordance with the Example and shows definitions of (i) a width wp1 of a first parasitic element included in an antenna element, (ii) a length lp1 of the first parasitic element, and (iii) a gap gap1 between the first parasitic element and a first stub.

Figure 9:
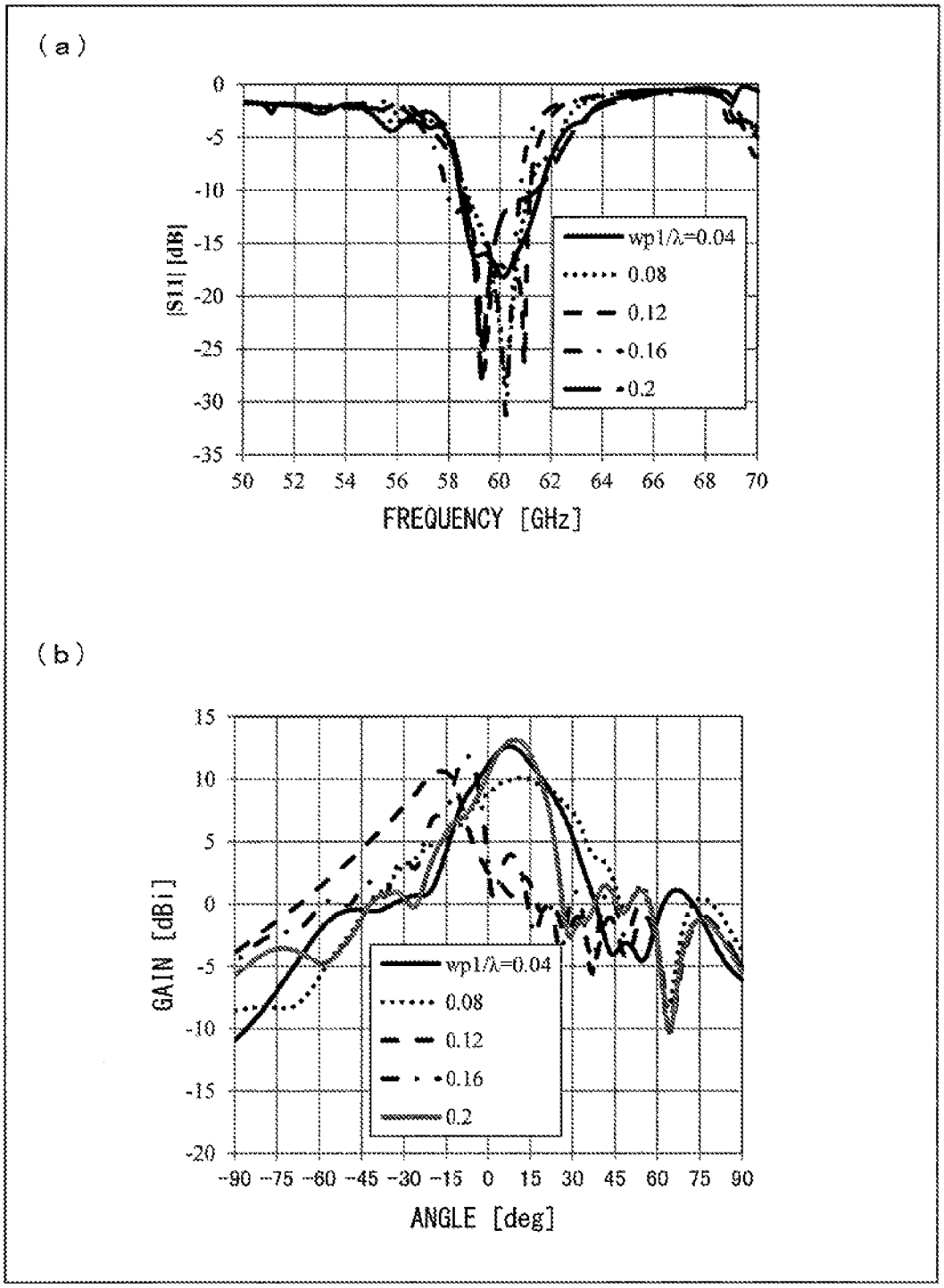

FIG. 9 is graphs showing characteristics of the antenna in accordance with the Example and obtained in a case where a normalized width wp1/λ is set at 0.04, 0.08, 0.12, 0.16, and 0.2. (a) of FIG. 9 is graphs each showing a reflection characteristic of the antenna in accordance with the Example. (b) of FIG. 9 is graphs each showing a radiation characteristic of the antenna in accordance with the Example.

Figure 10:
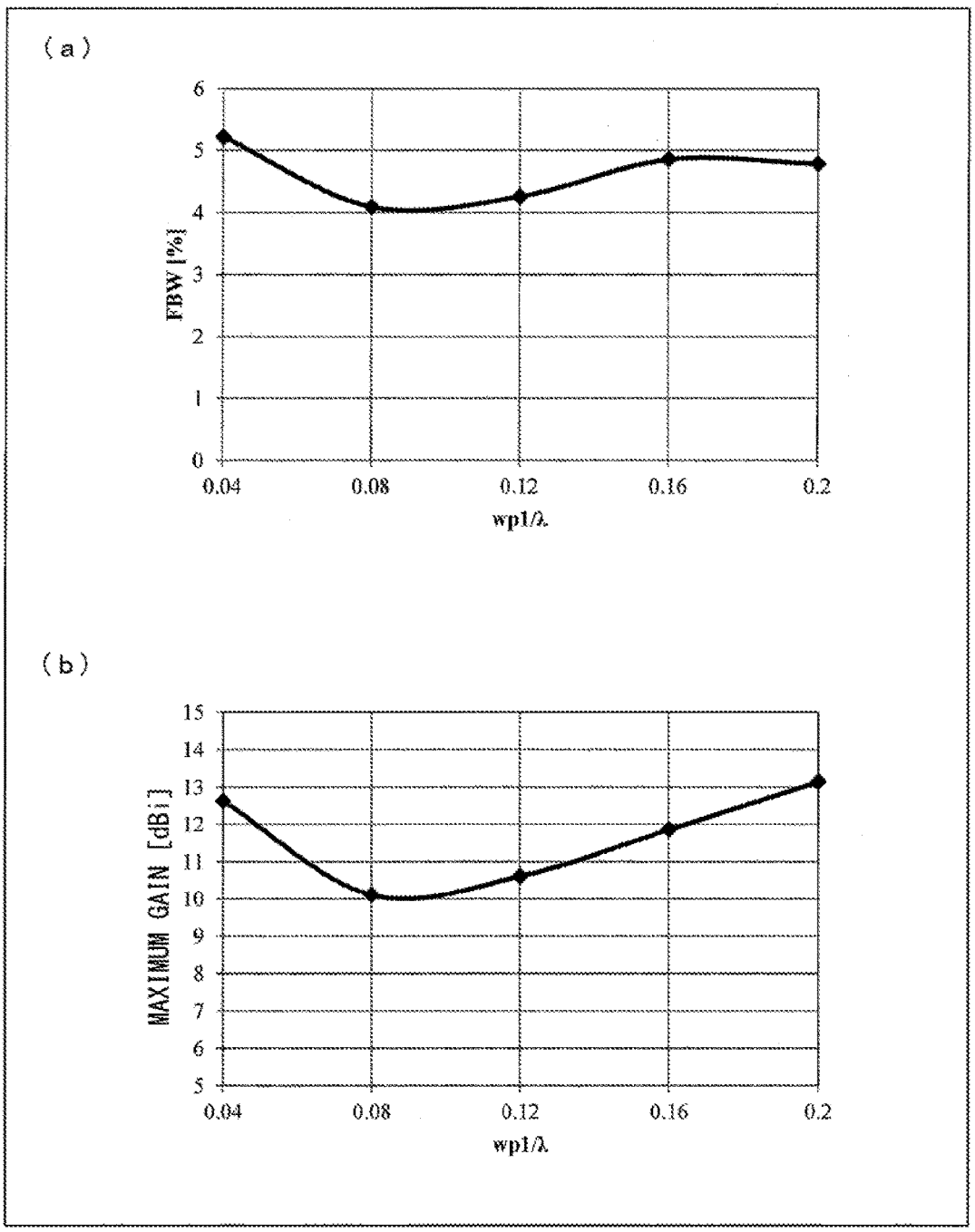

(a) of FIG. 10 is a graph showing a 10 dB fractional band width of the antenna in accordance with the Example and obtained in a case where the normalized width wp1/λ is set at 0.04, 0.08, 0.12, 0.16, and 0.2. (b) of FIG. 10 is a graph showing a maximum gain of the antenna in accordance with the Example and obtained in a case where the normalized width wp1/λ is set at 0.04, 0.08, 0.12, 0.16, and 0.2.

Figure 11:
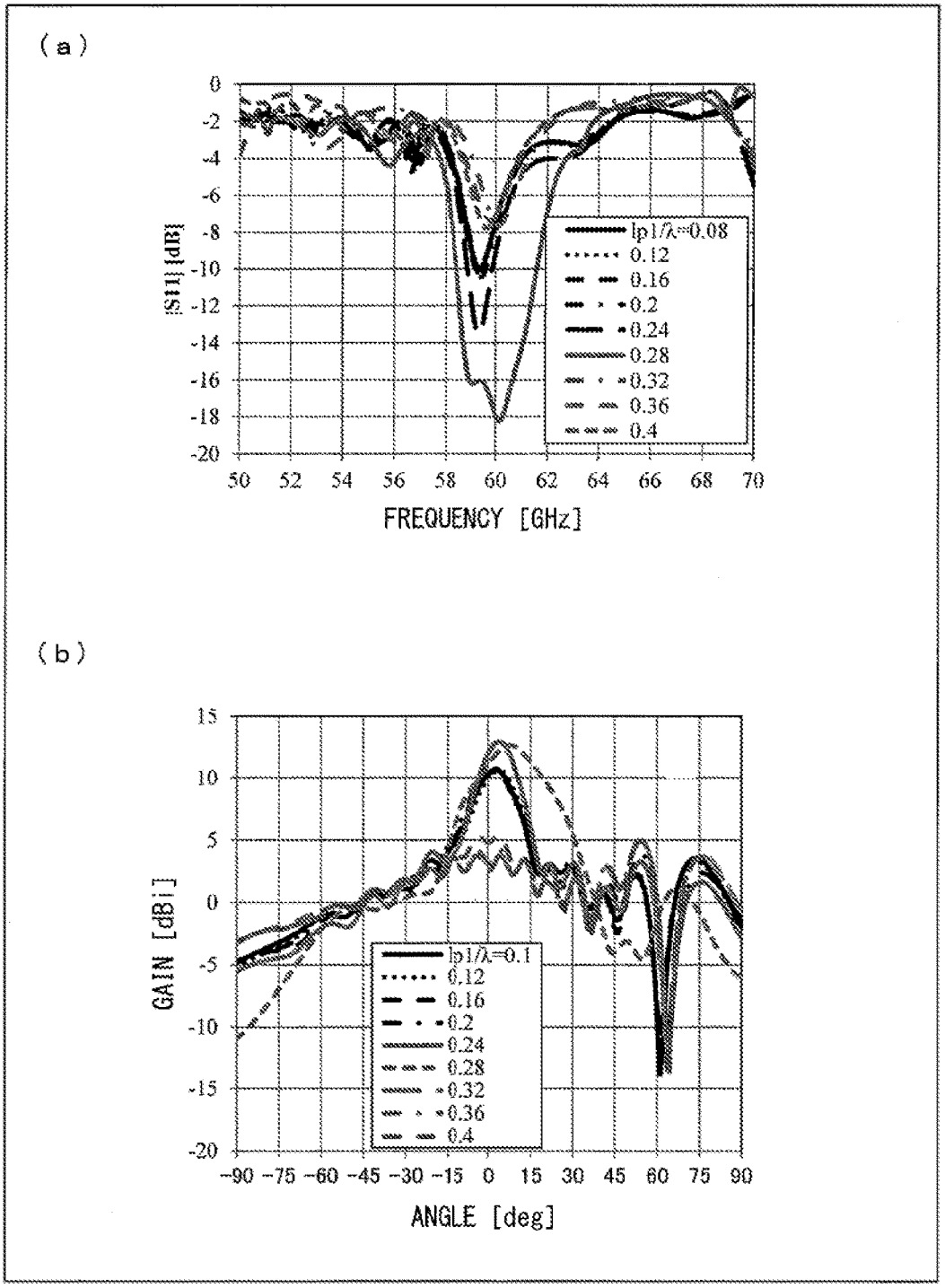

FIG. 11 is graphs showing characteristics of the antenna in accordance with the Example and obtained in a case where a normalized length lp1/λ is set at 0.08, 0.12, 0.16, 0.20, 0.24, 0.28, 0.32, 0.36, and 0.40. (a) of FIG. 11 is graphs each showing a reflection characteristic of the antenna in accordance with the Example. (b) of FIG. 11 is graphs each showing a radiation characteristic of the antenna in accordance with the Example.

Figure 12:
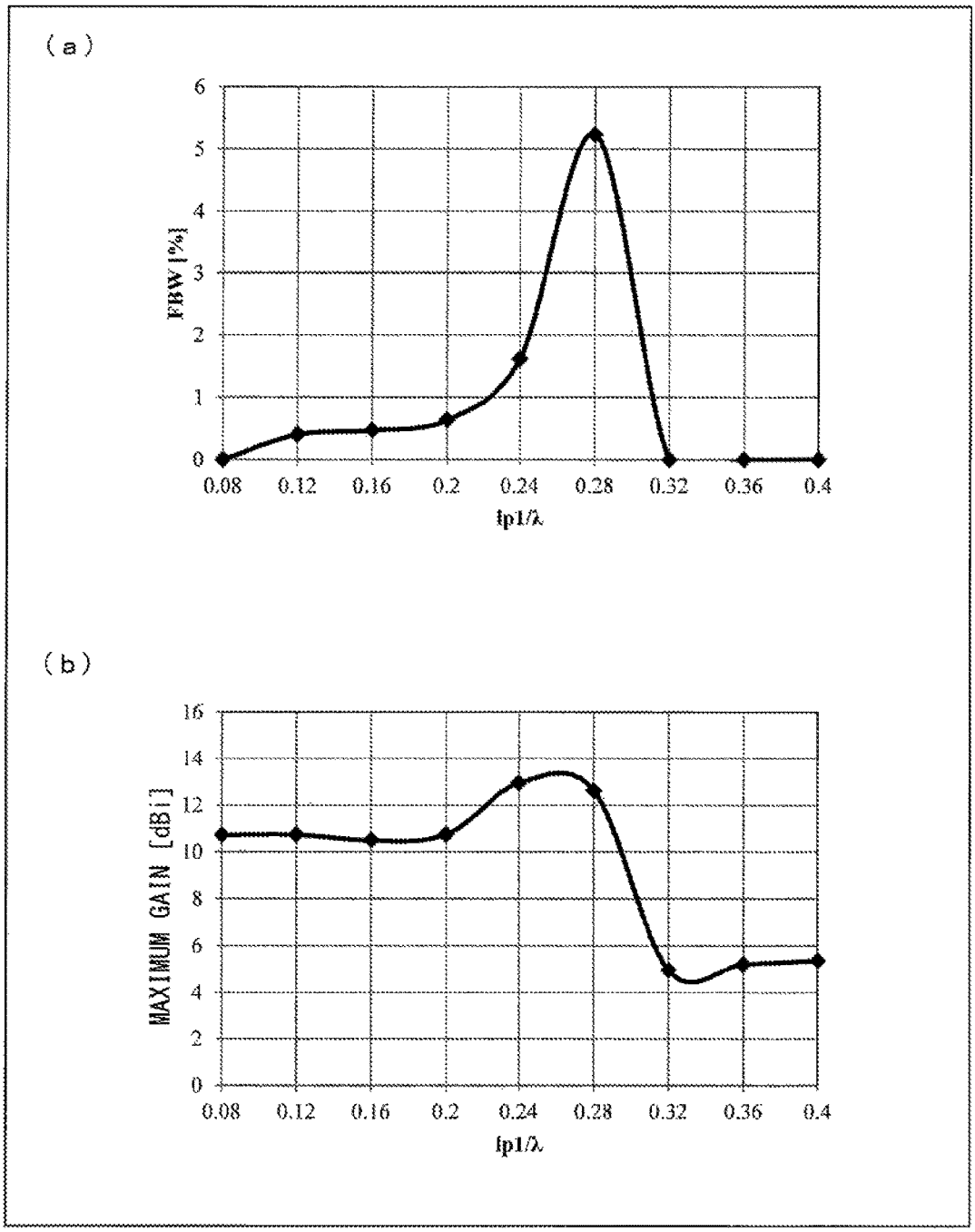

(a) of FIG. 12 is a graph showing the 10 dB fractional band width of the antenna in accordance with the Example and obtained in a case where the normalized length lp1/λ is set at 0.08, 0.12, 0.16, 0.20, 0.24, 0.28, 0.32, 0.36, and 0.40. (b) of FIG. 12 is a graph showing the maximum gain of the antenna in accordance with the Example and obtained in a case where the normalized length lp1/λ is set at 0.08, 0.12, 0.16, 0.20, 0.24, 0.28, 0.32, 0.36, and 0.40.

Figure 13:
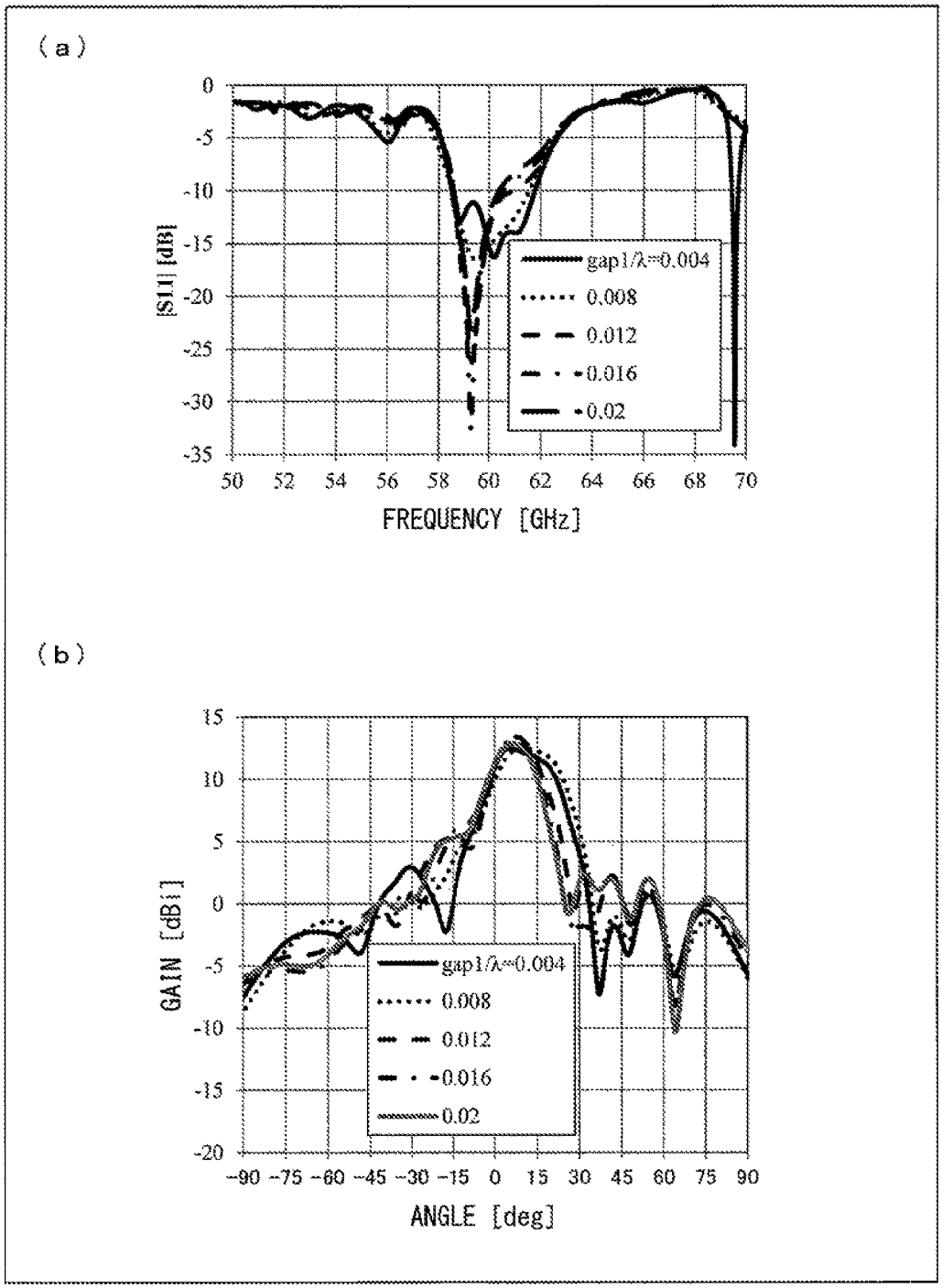

FIG. 13 is graphs showing characteristics of the antenna in accordance with the Example and obtained in a case where a normalized gap between the first parasitic element and the first stub gap1/λ is set at 0.004, 0.008, 0.012, 0.016, and 0.02. (a) of FIG. 13 is graphs each showing a reflection characteristic of the antenna in accordance with the Example. (b) of FIG. 13 is graphs each showing a radiation characteristic of the antenna in accordance with the Example.

Figure 14:
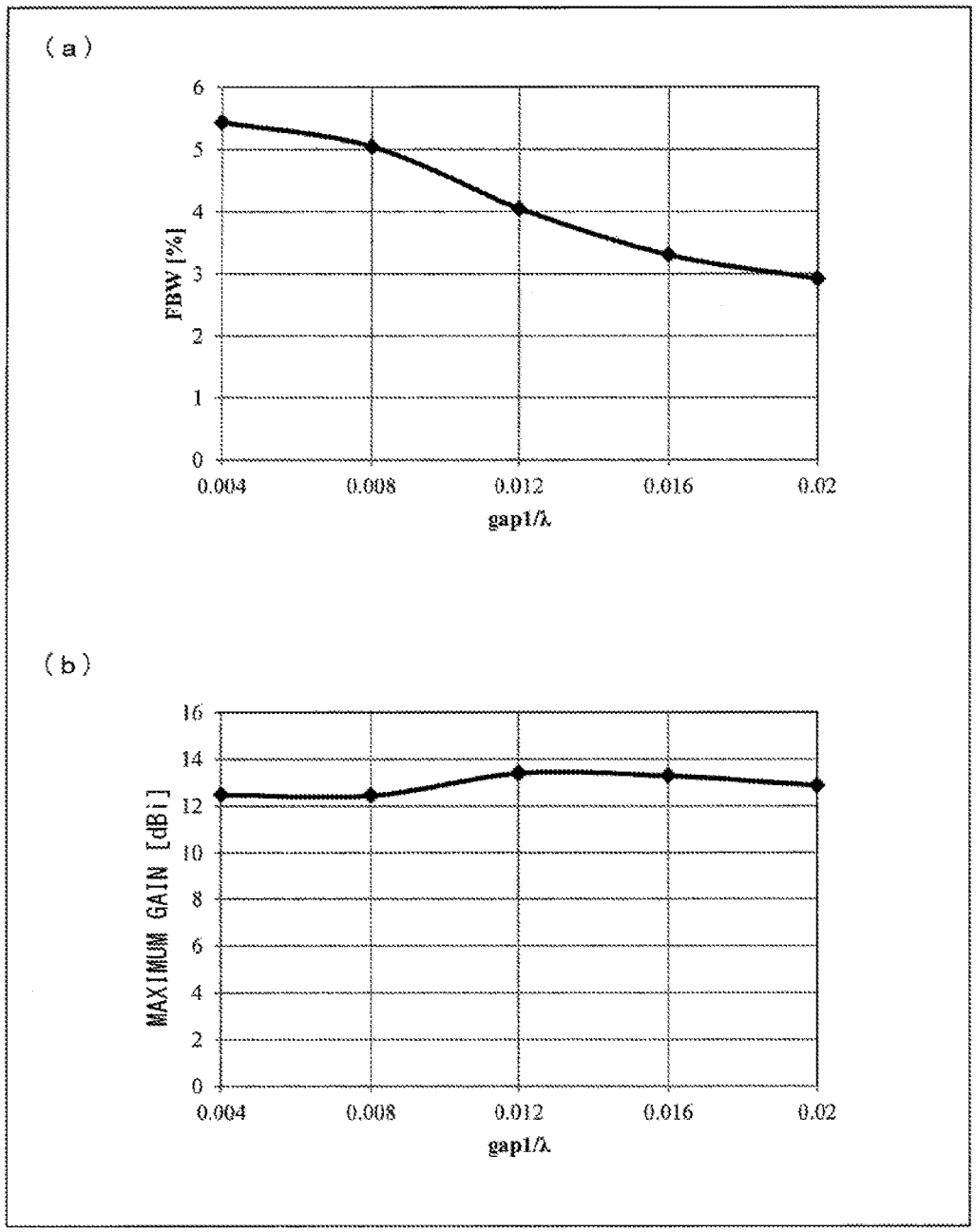

(a) of FIG. 14 is a graph showing the 10 dB fractional band width of the antenna in accordance with the Example and obtained in a case where the normalized gap between the first parasitic element and the first stub gap1/λ is set at 0.004, 0.008, 0.012, 0.016, and 0.02. (b) of FIG. 14 is a graph showing the maximum gain of the antenna in accordance with the Example and obtained in a case where the normalized gap between the first parasitic element and the first stub gap1/λ is set at 0.004, 0.008, 0.012, 0.016, and 0.02.

Figure 15:
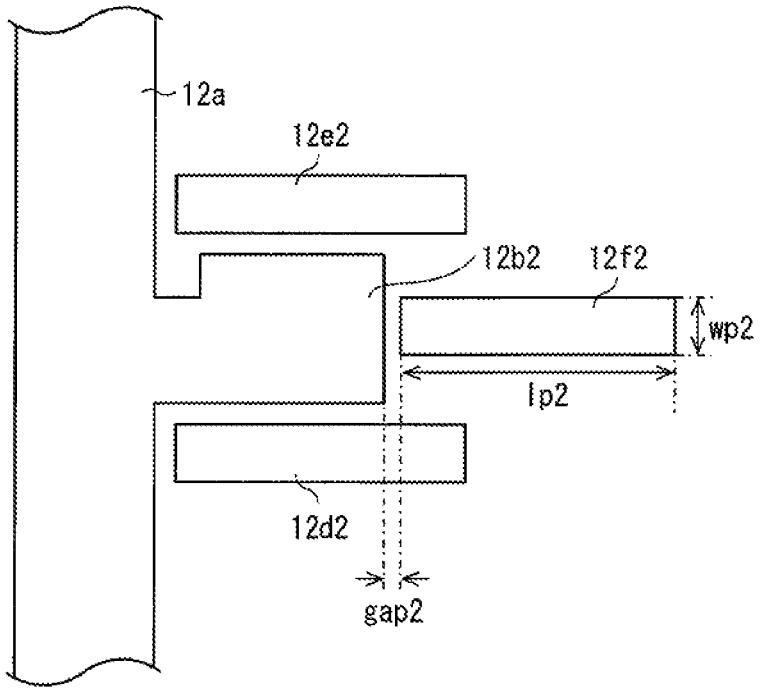

FIG. 15 is a plan view of the antenna in accordance with the Example and shows definitions of (i) a width wp2 of a third parasitic element included in an antenna element, (ii) a length lp2 of the third parasitic element, and (iii) a gap gap2 between the third parasitic element and the first stub.

Figure 16:
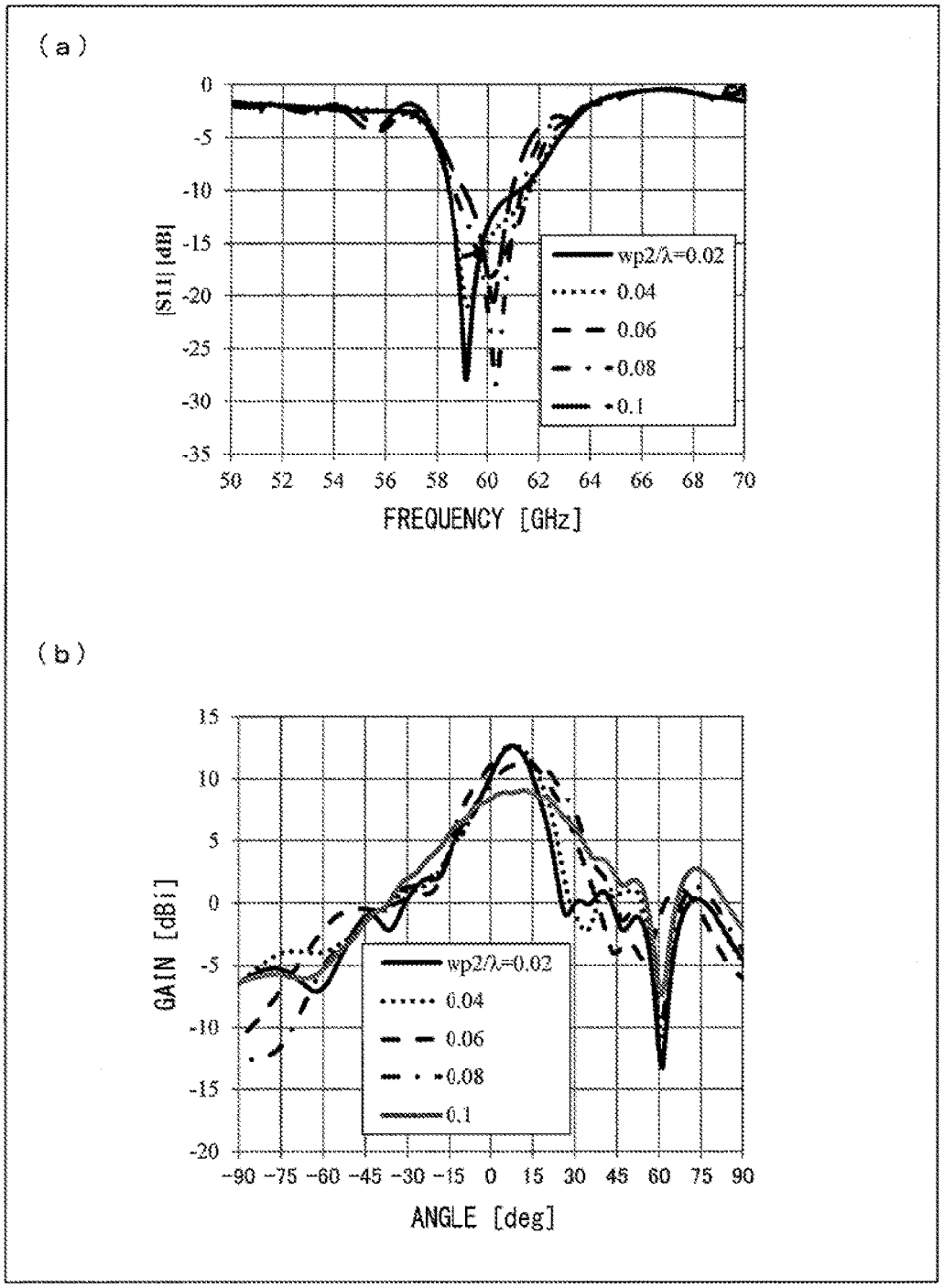

FIG. 16 is graphs showing characteristics of the antenna in accordance with the Example and obtained in a case where a normalized width wp2/λ is set at 0.02, 0.04, 0.06, 0.08, and 0.1. (a) of FIG. 16 is graphs each showing a reflection characteristic of the antenna in accordance with the Example. (b) of FIG. 16 is a view showing a radiation characteristic of the antenna in accordance with the Example.

Figure 17:
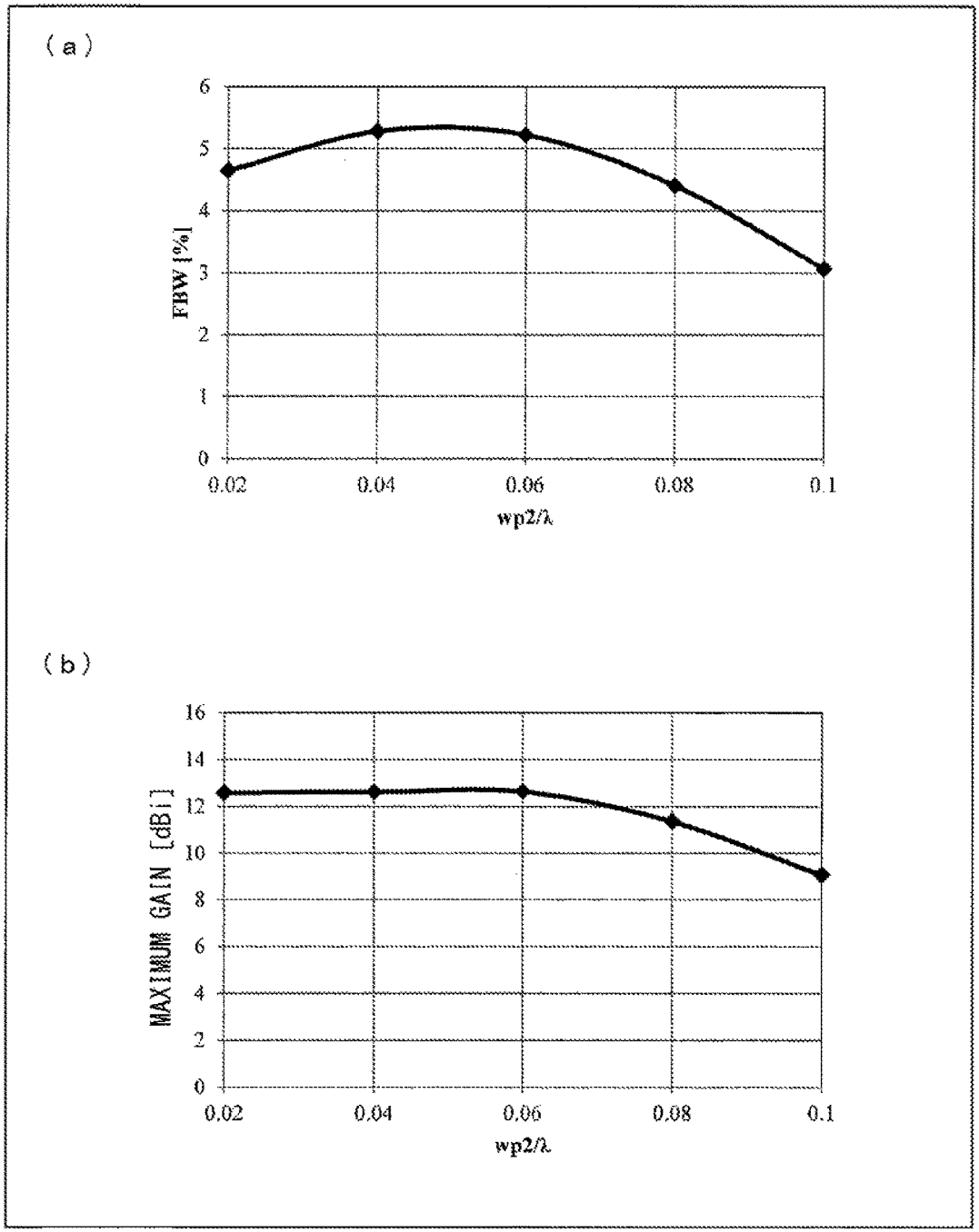

(a) of FIG. 17 is a graph showing the 10 dB fractional band width of the antenna in accordance with the Example and obtained in a case where the normalized width wp2/λ is set at 0.02, 0.04, 0.06, 0.08, and 0.1. (b) of FIG. 17 is a graph showing the maximum gain of the antenna in accordance with the Example and obtained in a case where the normalized width wp2/λ is set at 0.02, 0.04, 0.06, 0.08, and 0.1.

Figure 18:
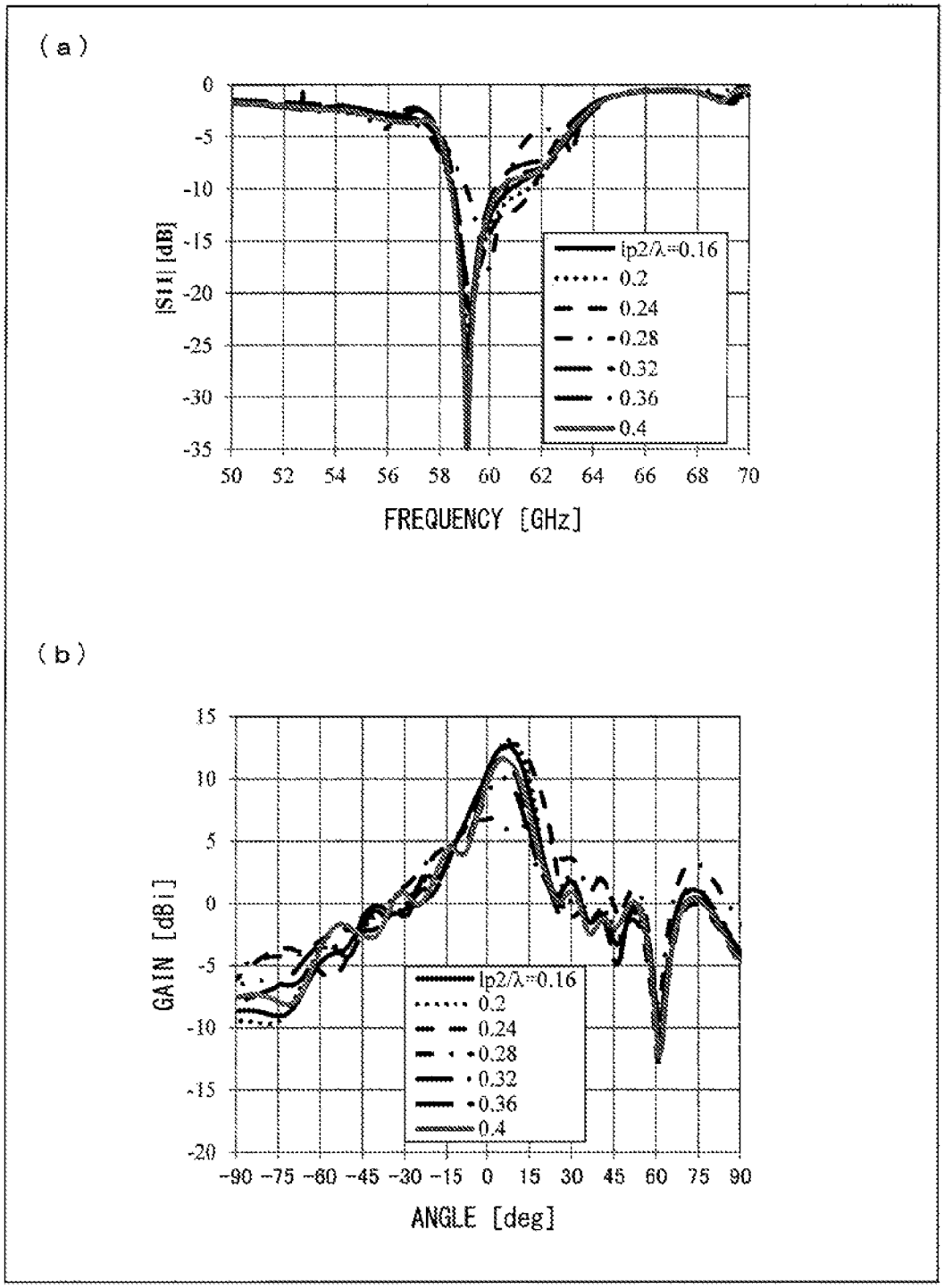

FIG. 18 is graphs showing characteristics of the antenna in accordance with the Example and obtained in a case where a normalized length lp2/λ is set at 0.08, 0.12, 0.16, 0.20, 0.24, 0.28, 0.32, 0.36, and 0.40. (a) of FIG. 18 is graphs each showing a reflection characteristic of the antenna in accordance with the Example. (b) of FIG. 18 is graphs each showing a radiation characteristic of the antenna in accordance with the Example.

Figure 19:
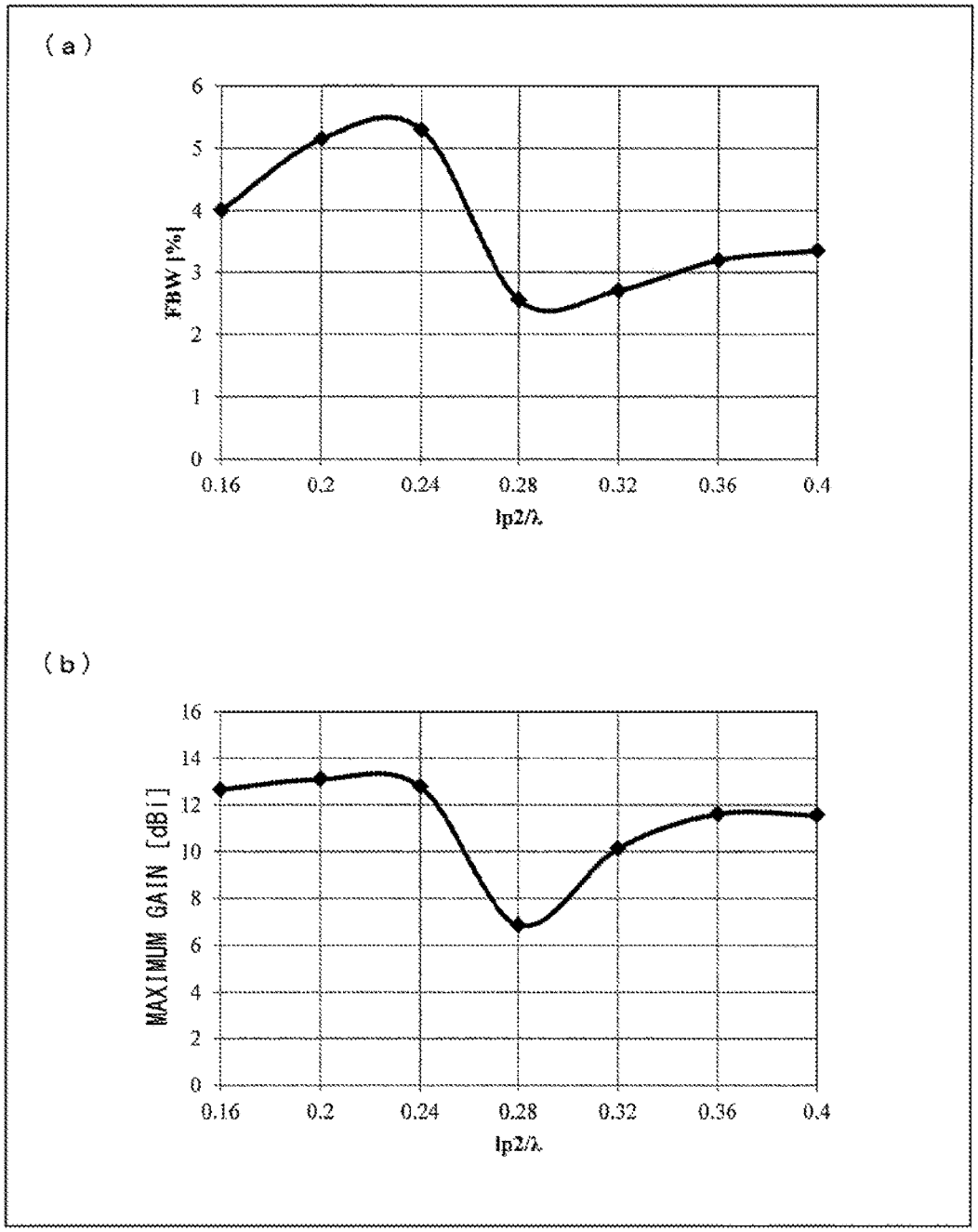

(a) of FIG. 19 is a graph showing the 10 dB fractional band width of the antenna in accordance with the Example and obtained in a case where the normalized length lp2/λ is set at 0.08, 0.12, 0.16, 0.20, 0.24, 0.28, 0.32, 0.36, and 0.40. (b) of FIG. 19 is a graph showing the maximum gain of the antenna in accordance with the Example and obtained in a case where the normalized length lp2/λ is set at 0.08, 0.12, 0.16, 0.20, 0.24, 0.28, 0.32, 0.36, and 0.40.

Figure 20:
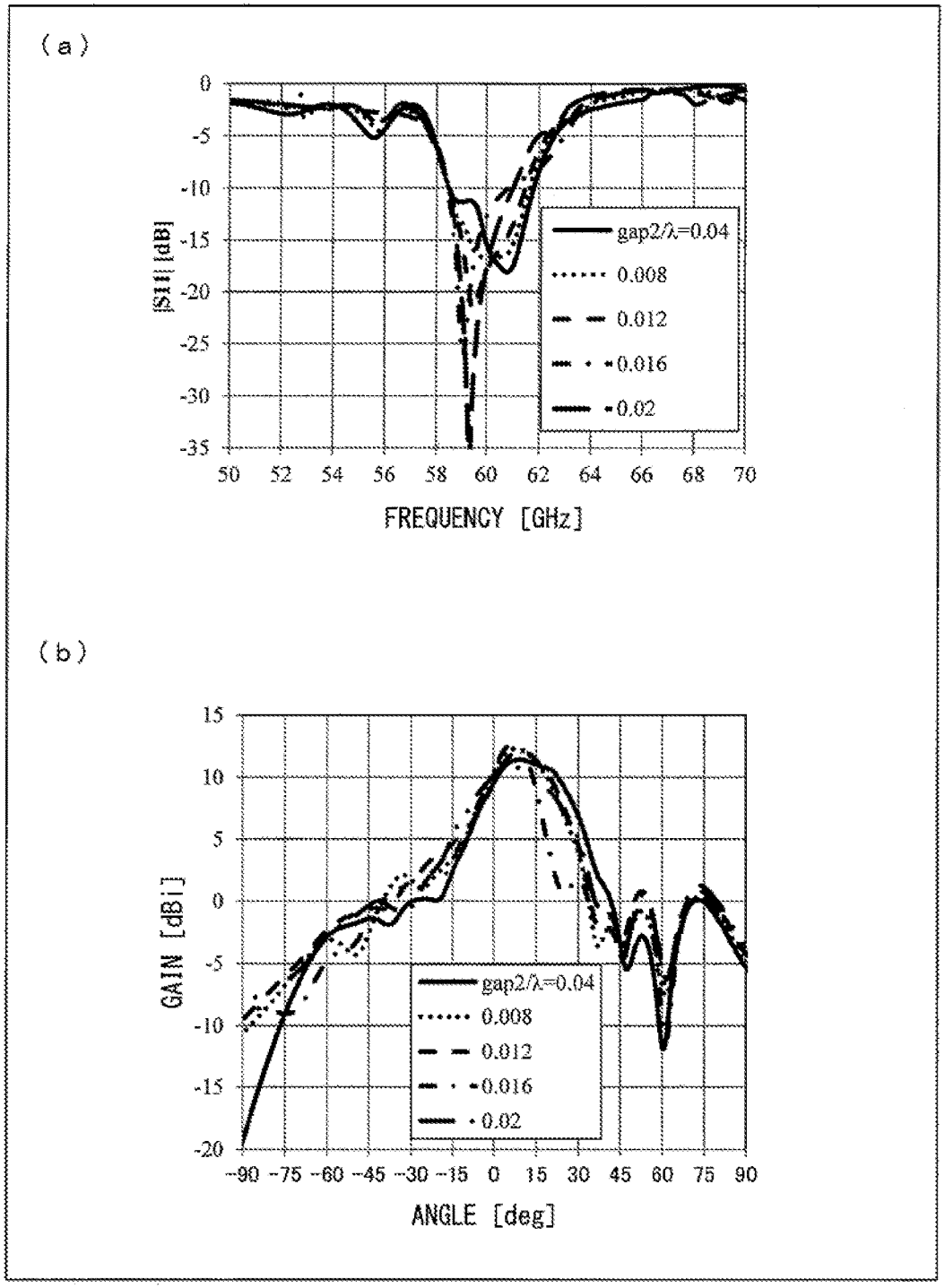

FIG. 20 is graphs showing characteristics of the antenna in accordance with the Example and obtained in a case where a normalized gap between the third parasitic element and the first stub gap2/λ is set at 0.004, 0.008, 0.012, 0.016, and 0.02. (a) of FIG. 20 is graphs each showing a reflection characteristic of the antenna in accordance with the Example. (b) of FIG. 20 is graphs each showing a radiation characteristic of the antenna in accordance with the Example.

Figure 21:
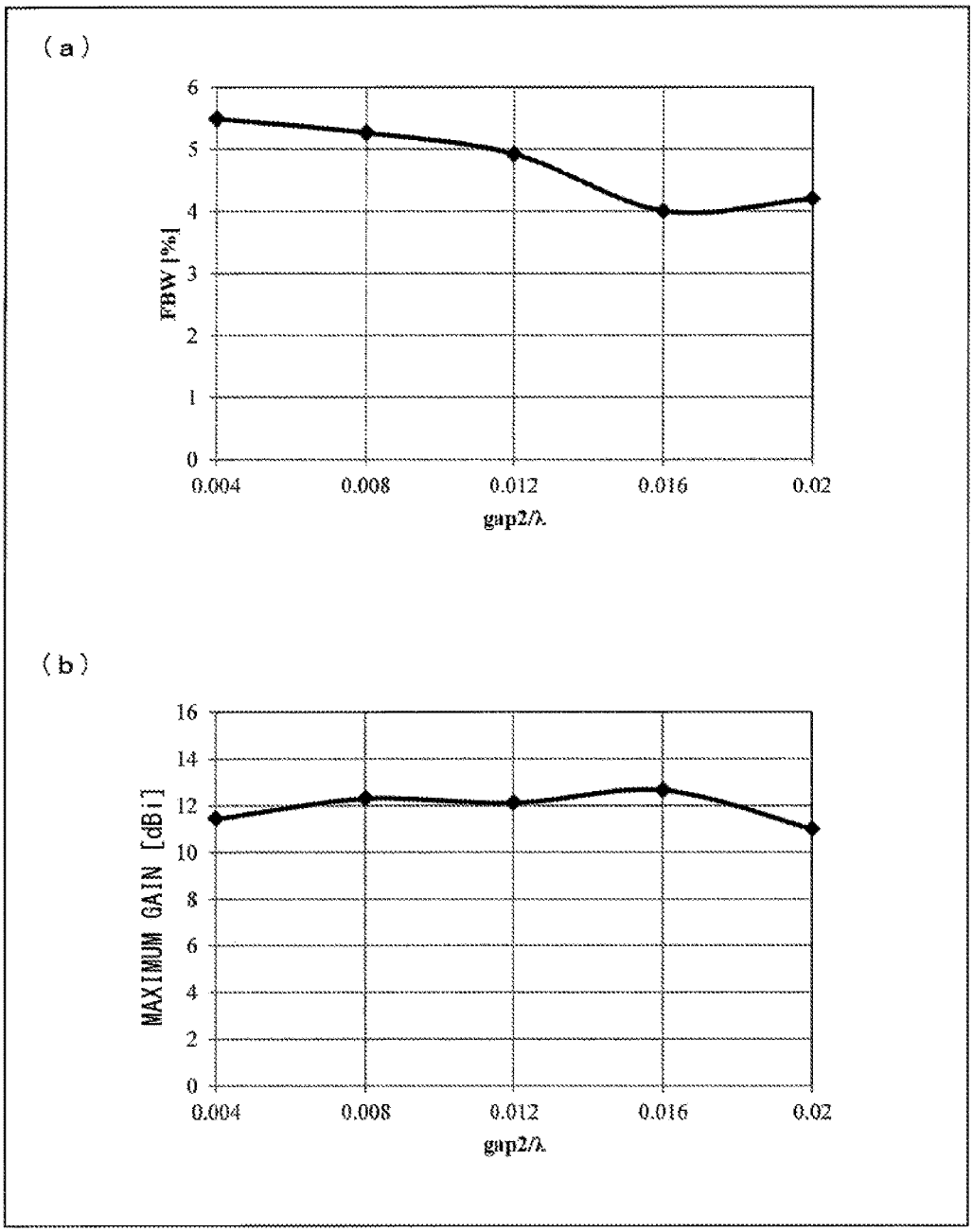

(a) of FIG. 21 is a graph showing the 10 dB fractional band width of the antenna in accordance with the Example and obtained in a case where the normalized gap between the third parasitic element and the first stub gap2/λ is set at 0.004, 0.008, 0.012, 0.016, and 0.02. (b) of FIG. 21 is a graph showing the maximum gain of the antenna in accordance with the Example and obtained in a case where the normalized gap between the third parasitic element and the first stub gap2/λ is set at 0.004, 0.008, 0.012, 0.016, and 0.02.

Figure 22:
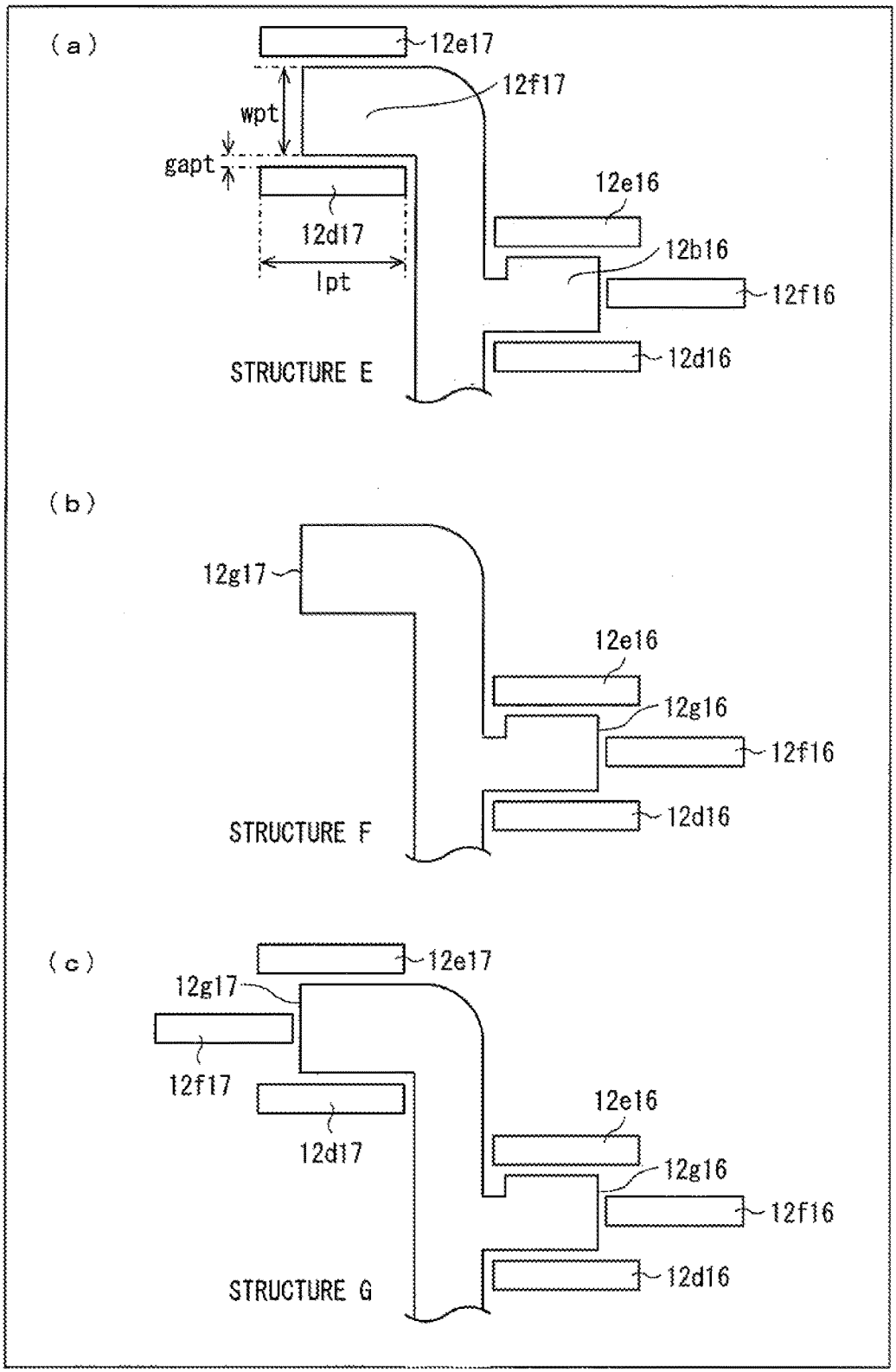

(a) of FIG. 22 is a plan view of the antenna in accordance with the Example and shows definitions of (i) a length lpt of a fourth parasitic element provided at a terminal end of a microstrip line, (ii) a width wpt of a second stub, and (iii) a gap gapt between the fourth parasitic element and the second stub. (b) and (c) of FIG. 22 are plan views of antennas in accordance with the Comparative Examples. The antennas in accordance with the Comparative Examples are each obtained by omitting, in the antenna in accordance with the Example, a parasitic element included in an antenna element, or by adding a new parasitic element in the antenna in accordance with the Example.

Figure 23:
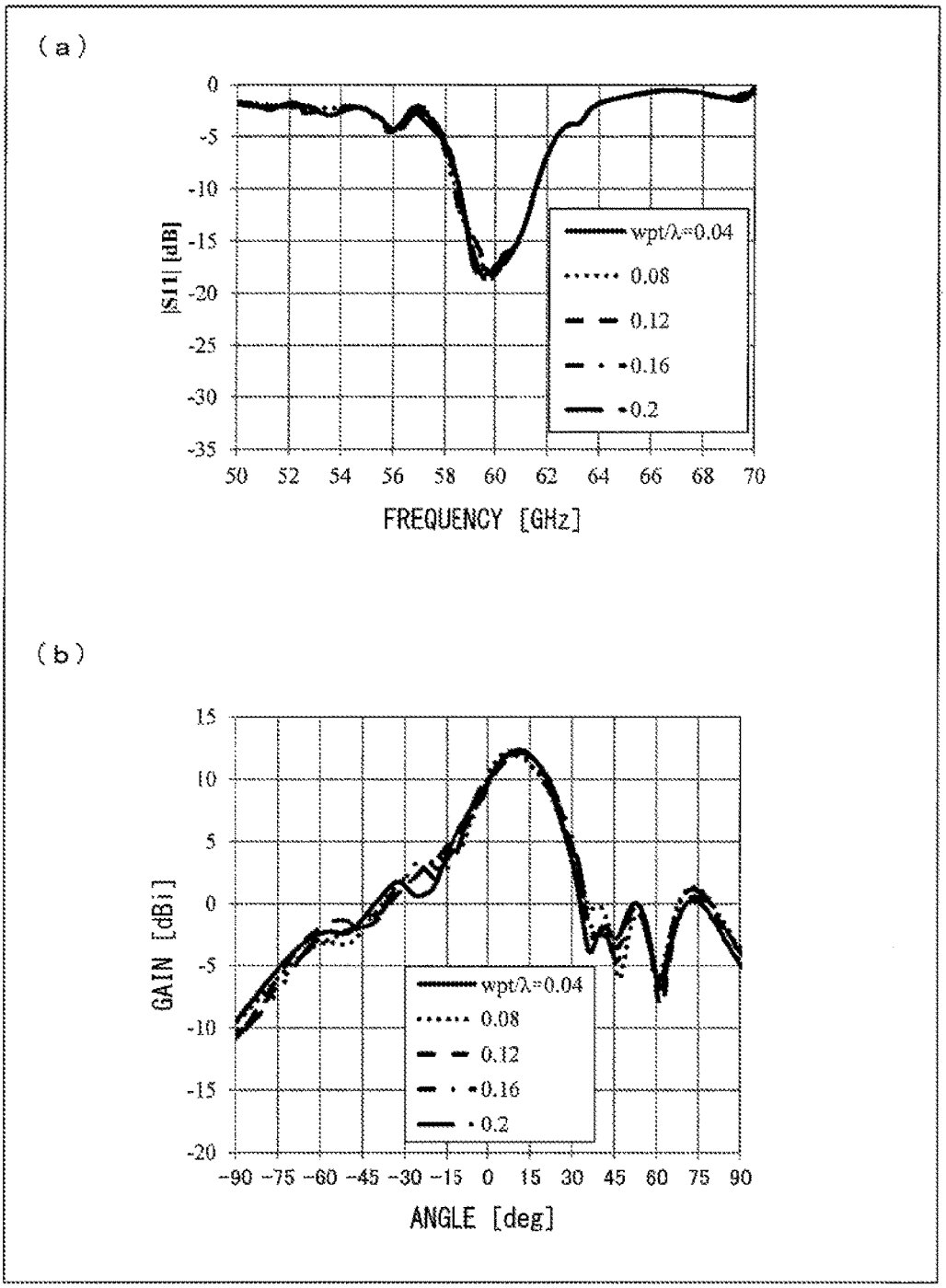

FIG. 23 is graphs showing characteristics of the antenna in accordance with the Example and obtained in a case where a normalized width wpt/λ is set at 0.04, 0.08, 0.12, 0.16, and 0.2. (a) of FIG. 23 is graphs each showing a reflection characteristic of the antenna in accordance with the Example. (b) of FIG. 23 is a view showing a radiation characteristic of the antenna in accordance with the Example.

Figure 24:
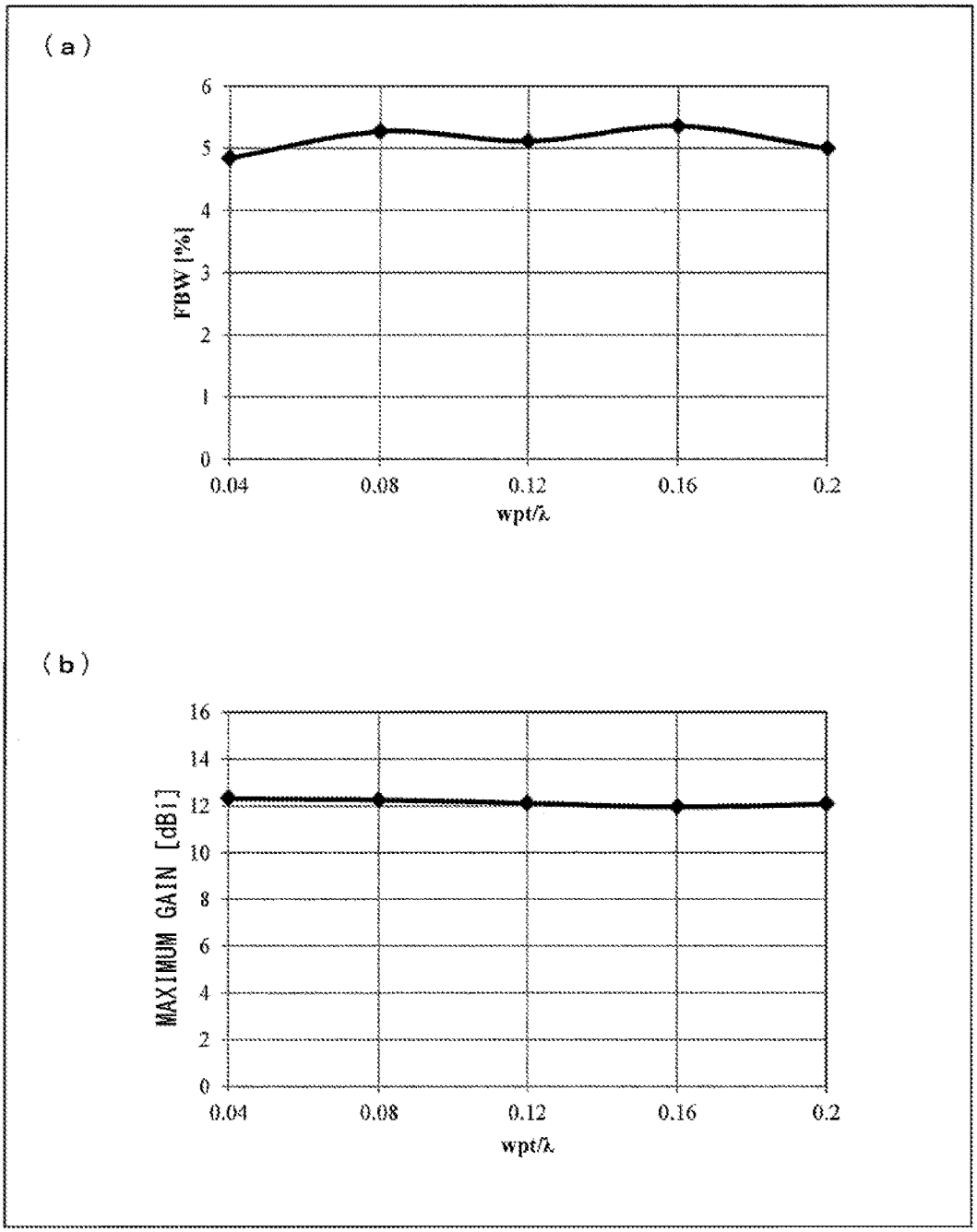

(a) of FIG. 24 is a graph showing the 10 dB fractional band width of the antenna in accordance with the Example and obtained in a case where the normalized width wpt/λ is set at 0.04, 0.08, 0.12, 0.16, and 0.2. (b) of FIG. 24 is a graph showing the maximum gain of the antenna in accordance with the Example and obtained in a case where the normalized width wpt/λ is set at 0.04, 0.08, 0.12, 0.16, and 0.2.

Figure 25:
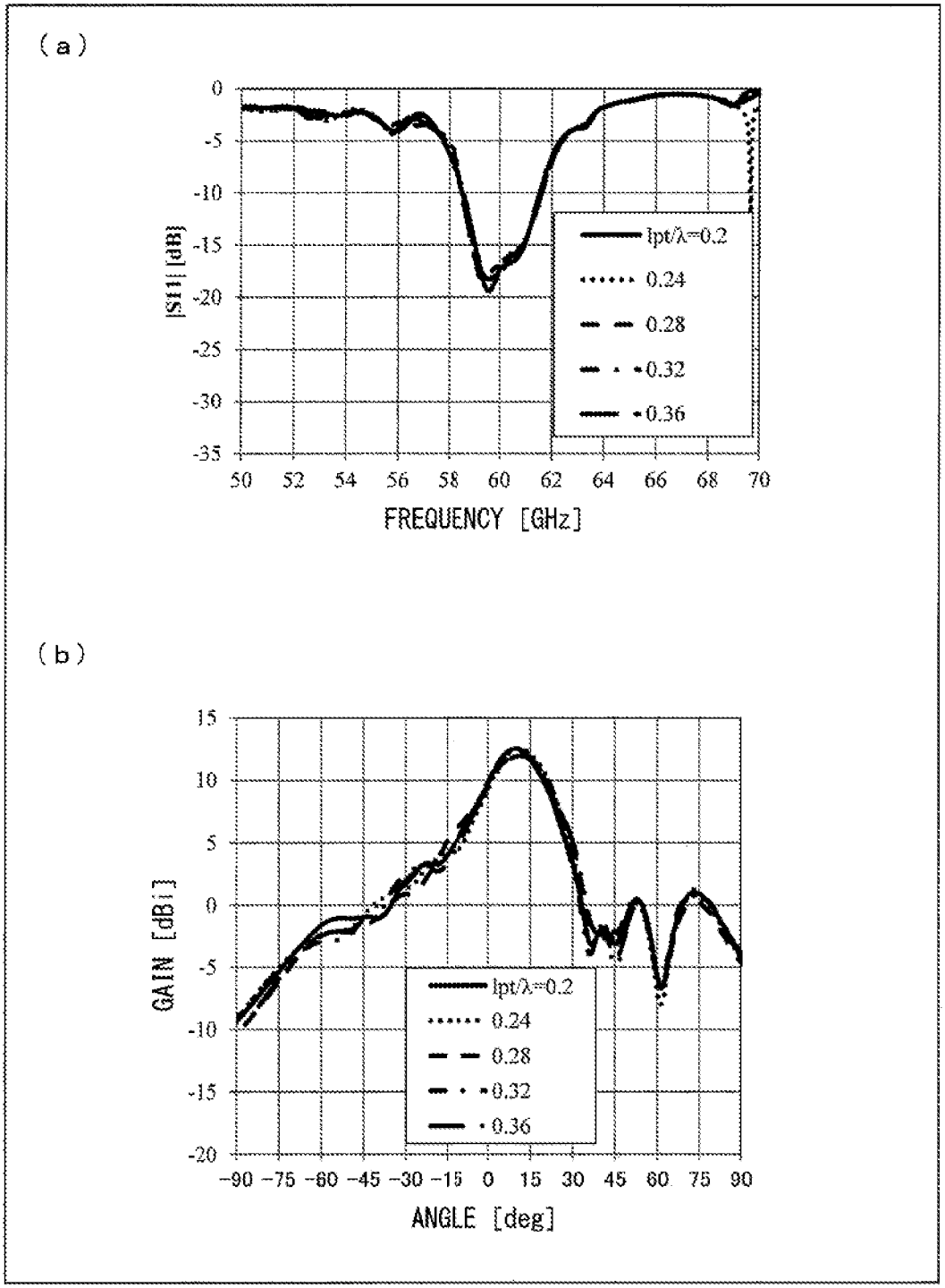

FIG. 25 is graphs showing characteristics of the antenna in accordance with the Example and obtained in a case where a normalized length lpt/λ is set at 0.2, 0.24, 0.28, 0.32, and 0.36. (a) of FIG. 25 is graphs each showing a reflection characteristic of the antenna in accordance with the Example. (b) of FIG. 25 is graphs each showing a radiation characteristic of the antenna in accordance with the Example.

Figure 26:
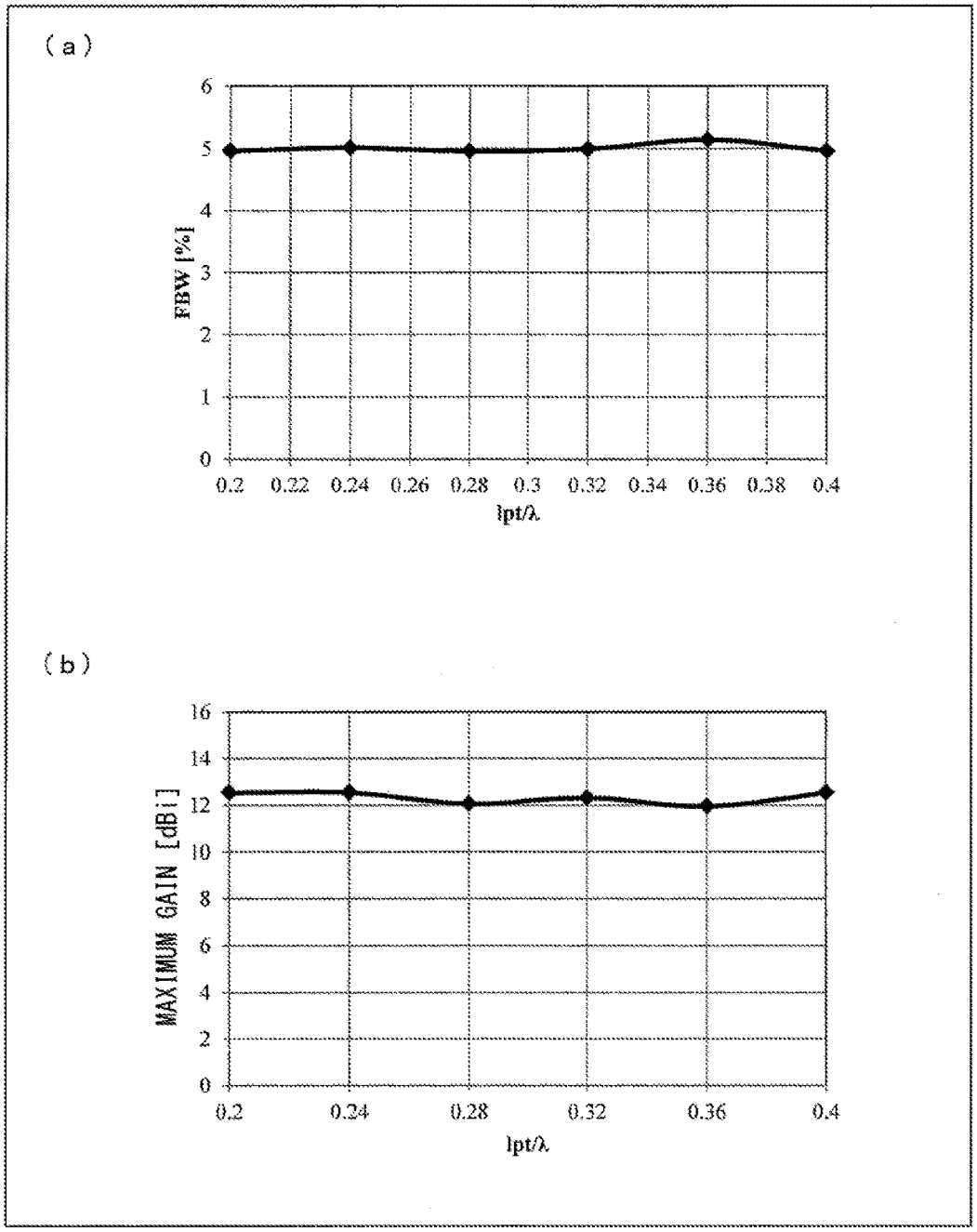

(a) of FIG. 26 is a graph showing the 10 dB fractional band width of the antenna in accordance with the Example and obtained in a case where the normalized length lpt/λ is set at 0.2, 0.24, 0.28, 0.32, and 0.36. (b) of FIG. 26 is a graph showing the maximum gain of the antenna in accordance with the Example and obtained in a case where the normalized length lpt/λ is set at 0.2, 0.24, 0.28, 0.32, and 0.36.

Figure 27:
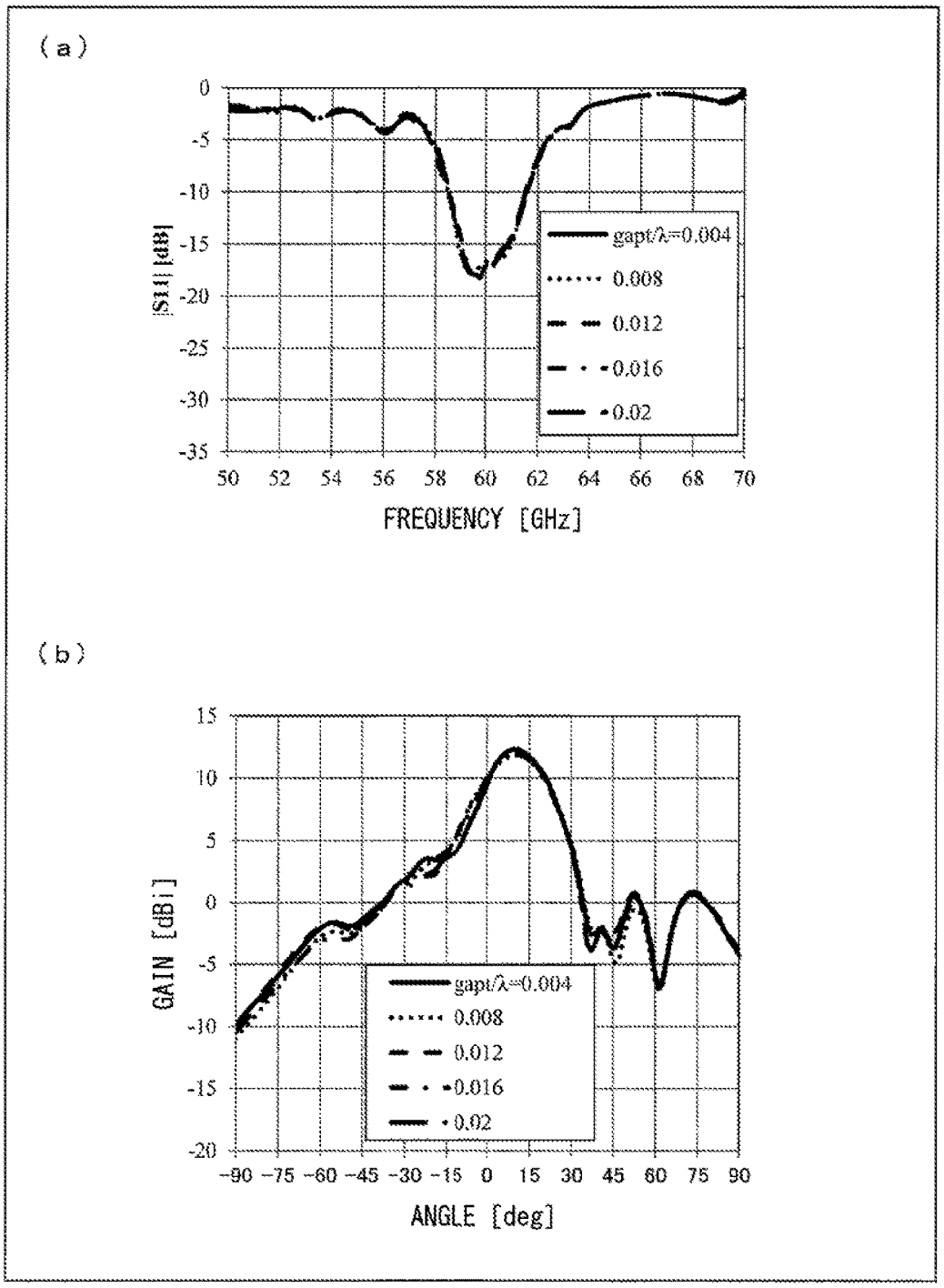

FIG. 27 is graphs showing characteristics of the antenna in accordance with the Example and obtained in a case where a normalized gap between the fourth parasitic element and the second stub gapt/λ is set at 0.004, 0.008, 0.012, 0.016, and 0.02. (a) of FIG. 27 is graphs each showing a reflection characteristic of the antenna in accordance with the Example. (b) of FIG. 27 is graphs each showing a radiation characteristic of the antenna in accordance with the Example.

Figure 28:
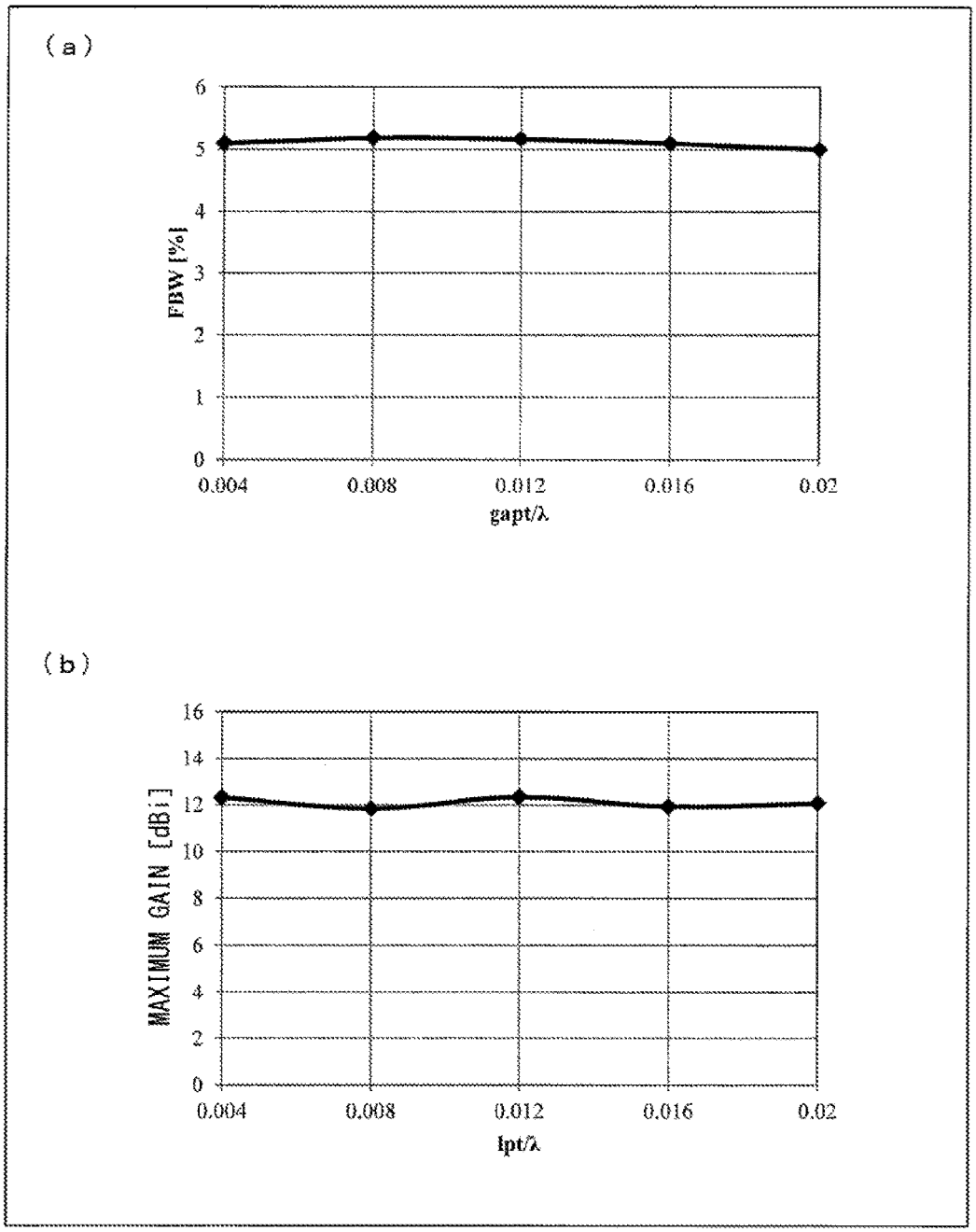

(a) of FIG. 28 is a graph showing the 10 dB fractional band width of the antenna in accordance with the Example and obtained in a case where the gap between the fourth parasitic element and the second stub gapt/λ is set at 0.004, 0.008, 0.012, 0.016, and 0.02. (b) of FIG. 28 is a graph showing the maximum gain of the antenna in accordance with the Example and obtained in a case where the gap between the fourth parasitic element and the second stub gapt/λ is set at 0.004, 0.008, 0.012, 0.016, and 0.02.

Figure 29:
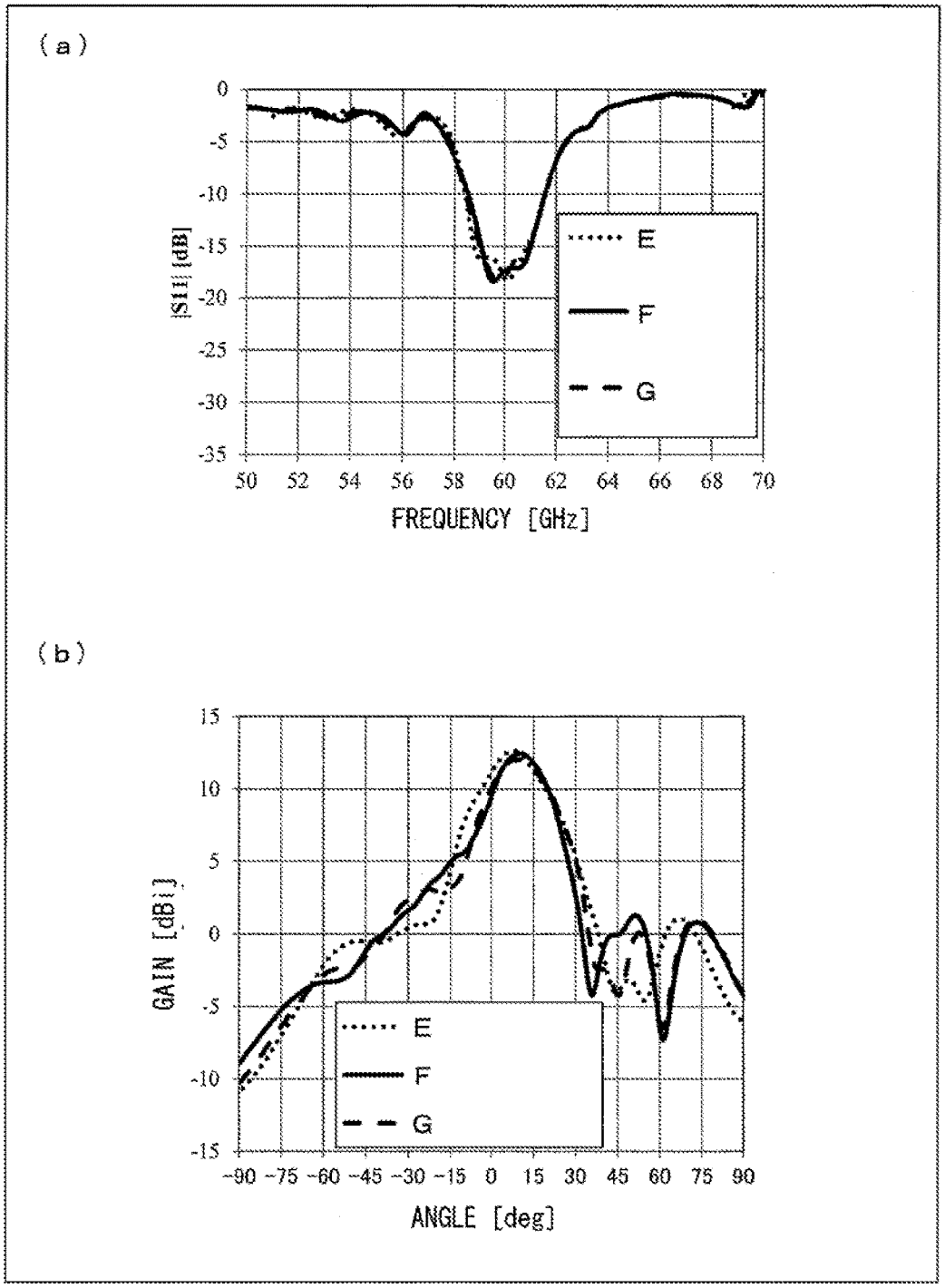

FIG. 29 is graphs showing characteristics of the antennas illustrated in (a) through (c) of FIG. 22. (a) of FIG. 29 is graphs showing respective reflection characteristics of the antennas illustrated in (a) through (c) of FIG. 22. (b) of FIG. 29 is graphs showing respective radiation characteristics of the antennas illustrated in (a) through (c) of FIG. 22.

DESCRIPTION OF EMBODIMENTS

[Arrangement of Antenna]

Figure 1:
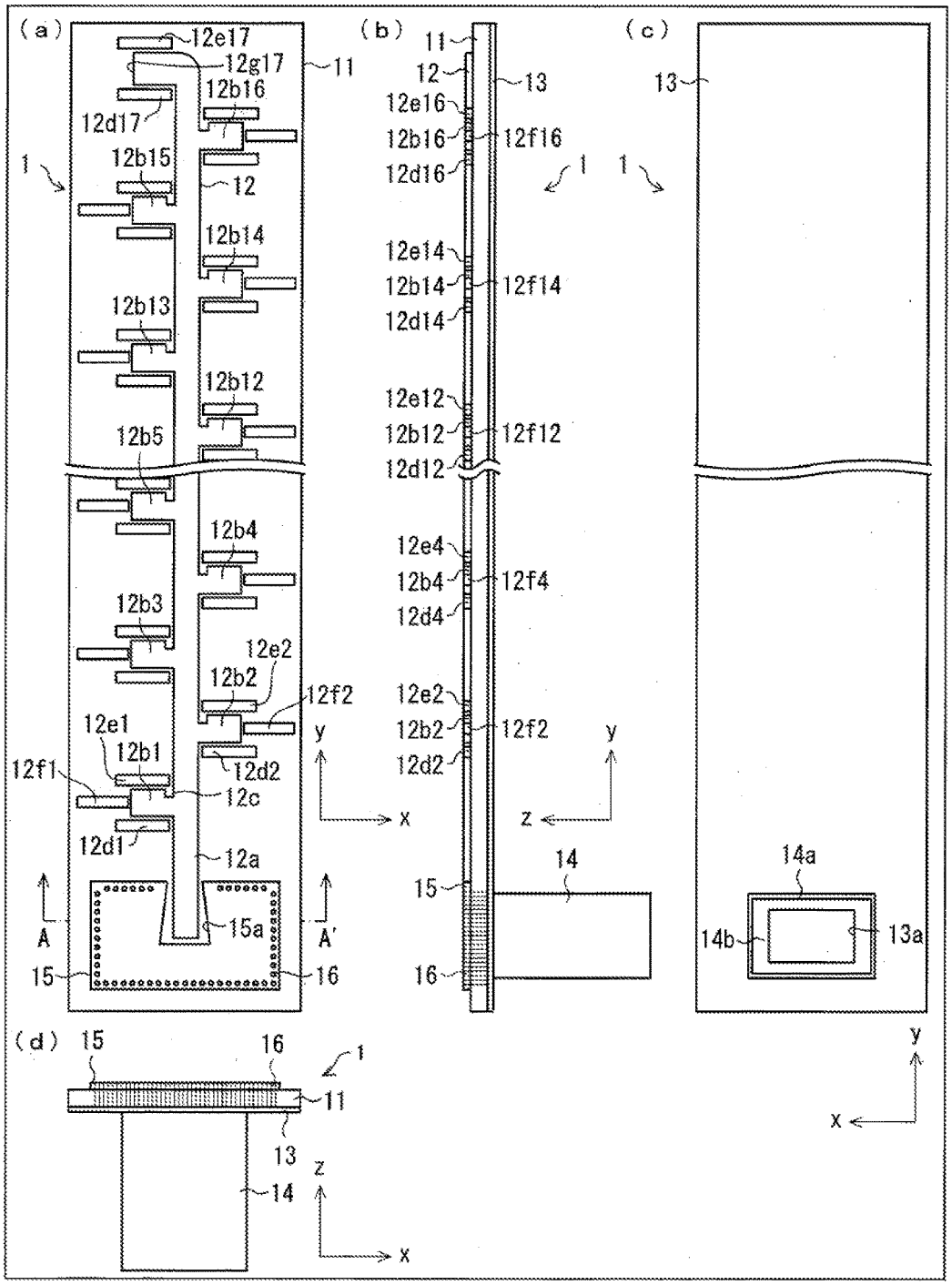

An arrangement of an antenna 1 in accordance with an embodiment of the present invention is described below with reference to FIG. 1. (a) of FIG. 1 is a plan view of the antenna 1. (b) of FIG. 1 is a side view of the antenna 1. (c) of FIG. 1 is a bottom view of the antenna 1. (d) of FIG. 1 is an elevation view of the antenna 1.

The antenna 1 includes a dielectric substrate 11, an antenna conductor 12, a ground conductor 13, a waveguide 14, a shield 15, and short-circuit parts 16. The antenna 1 is obtained by attaching the waveguide 14, the shield 15, and the short-circuit parts 16 to a microstrip antenna constituted by the dielectric substrate 11, the antenna conductor 12, and the ground conductor 13.

The dielectric substrate 11 is a plate member having a rectangular main surface, and is made of a dielectric substance such as resin. According to the present embodiment, a liquid crystal polymer (LCP) substrate made of a liquid crystal polymer is used as the dielectric substrate 11.

In the present specification, of six surfaces constituting an entire surface of the dielectric substrate 11, two surfaces having the largest area are each referred to as a "main surface", and the other four surfaces are each referred to as an "end surface". In a case where it is necessary to distinguish between the two main surfaces of the dielectric substrate 11, one and the other of the two main surfaces are referred to as a "front surface" and a "back surface", respectively. Further, the present specification uses a coordinate system in which an x-axis is an axis parallel to a short side of a main surface of the dielectric substrate 11, a y-axis is an axis parallel to a long side of the main surface of the dielectric substrate 11, and a z-axis is an axis orthogonal to the main surface of the dielectric substrate 11.

The antenna conductor 12 is a foil member provided on a front surface of the dielectric substrate 11, and is made of a conductor such as metal. According to the present embodiment, copper foil provided on the front surface of the dielectric substrate 11 is used as the antenna conductor 12.

The antenna conductor 12 is a comb-line antenna conductor in which a plurality of stubs **12*b*1 through 12*b*16 and a stub 12*g*17 are attached to a power feeding line 12*a*, which extends in a direction (first direction) parallel to the y-axis. In a vicinity of each stub 12*bi* that extends in an x-axis direction from an intermediate part of the power feeding line 12*a*, there are provided a first parasitic element 12*di*, a second parasitic element 12*ei*, and a third parasitic element 12*fi* (i=1, 2, . . . , 16). In a vicinity of the stub 12*g*17, which extends from a tip of the power feeding line 12*a*, there are provided a fourth parasitic element 12*d*17 and a fifth parasitic element 12*e*17**.

In the following description, the plurality of stubs **12*b*1 through 12*b*16 is collectively written as a "stub 12*b*" in a case where it is unnecessary to specify any one of the plurality of stubs 12*bl* through 12*b*16. Similarly, first parasitic elements 12*dl* through 12*d*16 are collectively written as a "first parasitic element 12*d*", second parasitic elements 12*e*1 through 12*e*16 are collectively written as a "second parasitic element 12*e*", and third parasitic elements 12*f*1 through 12*f*16 are collectively written as a "third parasitic element 12*f***".

The power feeding line **12*a* is a belt-shaped conductor serving as a trunk of the antenna conductor 12, and extends in parallel to the y-axis. Together with the ground conductor 13, which faces the power feeding line 12*a* via the dielectric substrate 11, the power feeding line 12*a* constitutes a microstrip line. An electromagnetic wave that has entered an input end (an end on the y-axis negative direction side) of the power feeding line 12*a* propagates through the microstrip line toward a terminal end (an end on the y-axis positive direction side) of the power feeding line 12*a***.

The stub **12*b* and the stub 12*g*17 are belt-shaped conductors serving as branches of the antenna conductor 12, and extend in a direction (second direction) parallel to the x-axis. Note here that the stub 12*b* is a stub whose starting point is the intermediate part (a part between the input end and the terminal end) of the power feeding line 12*a* and the stub 12*g*17 is a stub whose starting point is the terminal end of the power feeding line 12*a*. The stubs 12*b*1 through 12*b*16 include (i) first stubs extending from the power feeding line 12*a* in an x-axis negative direction (stubs each having a reference sign whose final number is an odd number) and (ii) second stubs extending from the power feeding line 12*a* in an x-axis positive direction (stubs each having a reference sign whose final number is an even number). The first stubs and the second stubs are alternately provided along the power feeding line 12*a*. The stub 12*b* has a root provided with a slit 12***c* that extends from the terminal end side of the power feeding line 12*a* toward the input end side of the power feeding line 12*a*. The stub 12*g*17, which is provided at the terminal end of the power feeding line 12*a*, extends in the x-axis negative direction.

The first parasitic element 12*d* is provided so as to face a side (first side) of the stub 12*b* which side is on the y-axis negative direction (direction opposite to the first direction) side. The second parasitic element 12*e* is provided so as to face a side (second side) of the stub 12*b* which side is on the y-axis positive direction (first direction) side. The third parasitic element 12*f* is provided so as to face a side (third side) of the stub 12*b* which side is on the x-axis direction side. The side on the x-axis direction side can be reworded as a side of the stub 12*b* which side is located at a terminal of the stub 12*b*.

The first parasitic element 12*d*, the second parasitic element 12*e*, and the third parasitic element 12*f* each preferably have a rectangular shape in which the x-axis direction is a longer side direction. Further, the shape of the first parasitic element 12*d* and the shape of the second parasitic element 12*e* are preferably congruent with each other.

The fourth parasitic element 12*d*17 is provided so as to face a side of the stub 12*g*17 provided at the terminal end of the power feeding line 12*a*, the side being on a side of a direction opposite to the y-axis direction. The fifth parasitic element 12*e*17 is provided so as to face a side of the stub 12*g*17 which side is on the y-axis direction side.

The fourth parasitic element 12*d*17 and the fifth parasitic element 12*e*17 each preferably have a rectangular shape in which the x-axis direction is a longer side direction. Further, the shape of the fourth parasitic element 12*d*17 and the shape of the fifth parasitic element 12*e*17 are preferably congruent with each other.

An electromagnetic wave that has propagated through the microstrip line constituted by the power feeding line 12*a* and the ground conductor 13 is radiated from the stub 12*b* to an outside. In this case, an electric current is induced also to the first parasitic element 12*d* that has been spatially coupled with the stub 12*b*, so that the electromagnetic wave is radiated also from the first parasitic element 12*d*. Similarly, the electromagnetic wave is radiated also from each of the second parasitic element 12*e* and the third parasitic element 12*f*. Specifically, the stub 12*b*, the first parasitic element 12*d*, the second parasitic element 12*e*, and the third parasitic element 12*f* function as a single antenna element, and the stub 12*g*17, the fourth parasitic element 12*d*17, and the fifth parasitic element 12*e*17 function as a single antenna element.

The first parasitic element 12*d*, the second parasitic element 12*e*, and the third parasitic element 12*f* are designed to have a resonance frequency that is close to a resonance frequency of the stub 12*b*. Similarly, the fourth parasitic element 12*d*17 and the fifth parasitic element 12*e*17 are designed to have a resonance frequency that is close to a resonance frequency of the stub 12*g*17. The first parasitic element 12*d*, the second parasitic element 12*e*, the third parasitic element 12*f*, the fourth parasitic element 12*d*17, and the fifth parasitic element 12*e*17 which are thus designed allow an operation band of the antenna 1 to be broader.

The ground conductor 13 is a foil member provided on a back surface of the dielectric substrate 11, and is made of a conductor such as metal. According to the present embodiment, copper foil provided on the back surface of the dielectric substrate 11 is used as the ground conductor 13.

The ground conductor 13 has an opening 13*a*. The opening 13*a* has a rectangular shape whose long side is parallel to the x-axis. The opening 13*a* is provided in a region of the back surface of the dielectric substrate 11 in which region the opening 13*a* overlaps the input end of the power feeding line 12*a*. The ground conductor 13 entirely covers the back surface of the dielectric substrate 11 except for this region.

The waveguide 14 is a tubular member whose both ends are open, and is made of a conductor such as metal. The waveguide 14 has therein a cavity 14*b* that has a rectangular transverse section (cross section orthogonal to a tube axis). The waveguide 14 is provided so that the tube axis is parallel to the z-axis and a longer side axis of the transverse section of the cavity 14*b* is parallel to the x-axis. Further, the waveguide 14 has a tube wall 14*a* whose z-axis positive direction side end surface is joined to the ground conductor 13. An image of the cavity 14*b* orthogonally projected onto an x-y plane includes an image of the opening 13*a* orthogonally projected onto the x-y plane.

The shield 15 is a foil member provided on the front surface of the dielectric substrate 11, and is made of a conductor such as metal. According to the present embodiment, copper foil provided on the front surface of the dielectric substrate 11 is used as the shield 15.

The shield 15 has a rectangular shape whose long sides are parallel to the x-axis and which is provided with a slit 15*a* that extends from the y-axis positive direction side long side toward the y-axis negative direction side long side. The shield 15 is provided so that the input end of the power feeding line 12*a* enters the slit 15*a*. Assuming that the slit 15*a* is absent, an image of the shield 15 orthogonally projected onto the x-y plane includes the image of the cavity 14*b* orthogonally projected onto the x-y plane.

The shield 15 is short-circuited with the ground conductor 13 via the short-circuit parts 16, which are through the dielectric substrate 11. The short-circuit parts 16 are provided, around an entire outer circumference of the shield 15 except for a place where the slit 15*a* is provided, so as to constitute a fence surrounding a region inside the dielectric substrate 11 which region overlaps the opening 13*a*.

The antenna 1 is supplied with an electromagnetic wave via the waveguide 14. A TE01 mode electromagnetic wave that propagates through the waveguide 14 in a z-axis positive direction enters the dielectric substrate 11 via the opening 13*a* of the ground conductor 13. The region inside the dielectric substrate 11 which region overlaps the opening 13*a* has sides that are surrounded by the short-circuit parts 16 and an upper part that is covered with the shield 15. Consequently, the electromagnetic wave that has entered the dielectric substrate 11 via the opening of the ground conductor 13 enters the input end of the power feeding line 12*a* without being dispersed around.

The antenna 1 is characteristic in that the slit 15*a* provided in the shield 15 has a reverse taper shape that has a greater width in an inner part of the slit 15*a*. The slit 15*a* which has a reverse taper shape allows an improvement in reflection characteristic and radiation characteristic of the antenna 1.

According to the present embodiment, the slit 15*a* has an exponential taper shape whose Napier's number is e and in which a position in a longer side direction is a variable. Note, however, that the shape of the slit 15 is not limited to such a shape. Specifically, the slit 15 can have a linear taper shape whose width is in proportion to a distance from an open end of the slit 15 or a parabolic taper shape whose width is in proportion to a square root of a distance from the open end.

Figure 2:
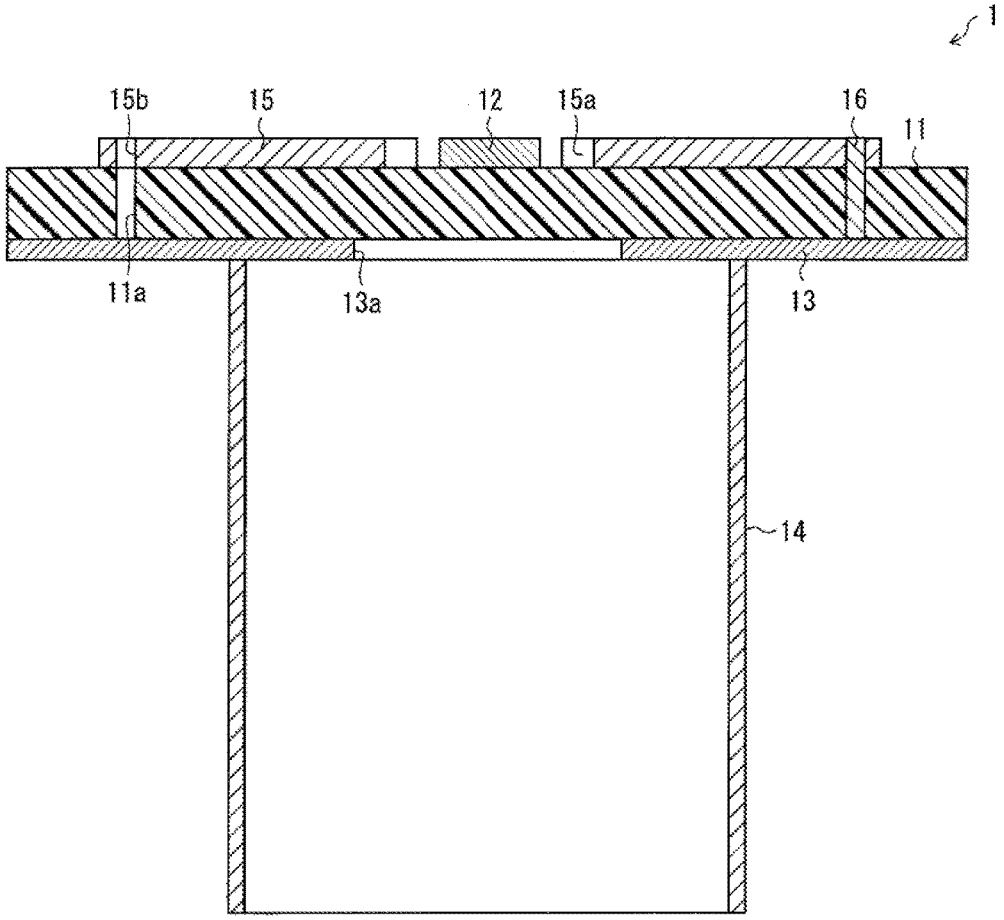
FIG. 2 is a cross sectional view, taken from line AA', of the antenna in accordance with the embodiment.

The following description additionally discusses a structure of a short-circuit part 16 with reference to FIG. 2. FIG. 2 is a cross sectional view, taken from line AA', of the antenna 1.

The shield 15 is provided with an opening 15*b* (see FIG. 2). The dielectric substrate 11 is provided with a through hole 11*a* that communicates with the opening 15*b* (see FIG. 2).

The opening 15*b* and the through hole 11*a* are each filled with a conductor such as solder. The conductor with which the opening 15*b* and the through hole 11*a* are each filled is brought into contact with both the shield 15 and the ground conductor 13, so that the shield 15 and the ground conductor 13 are short-circuited. The short-circuit part 16 is nothing but a conductor with which the opening 15*b* and the through hole 11*a* are each thus filled.

As described earlier, the antenna 1 of the present invention includes: the dielectric substrate 11; the antenna conductor 12 including: the power feeding line 12*a* that extends in the first direction; and the stub 12*b*; the ground conductor 13; the first parasitic element 12*d* facing a first side of the stub 12*b* which first side is on a side of a direction opposite to the first direction; and the second parasitic element 12*e* facing a second side of the stub 12*b* which second side is on the first direction side.

This makes it possible to provide an antenna that allows expansion of a width of a band in which an excellent reflection characteristic and an excellent radiation characteristic are exhibited.

EXAMPLES

Next, an example of the antenna 1 illustrated in FIG. 1 is described below with reference to FIGS. 3 through 6.

Figure 3:
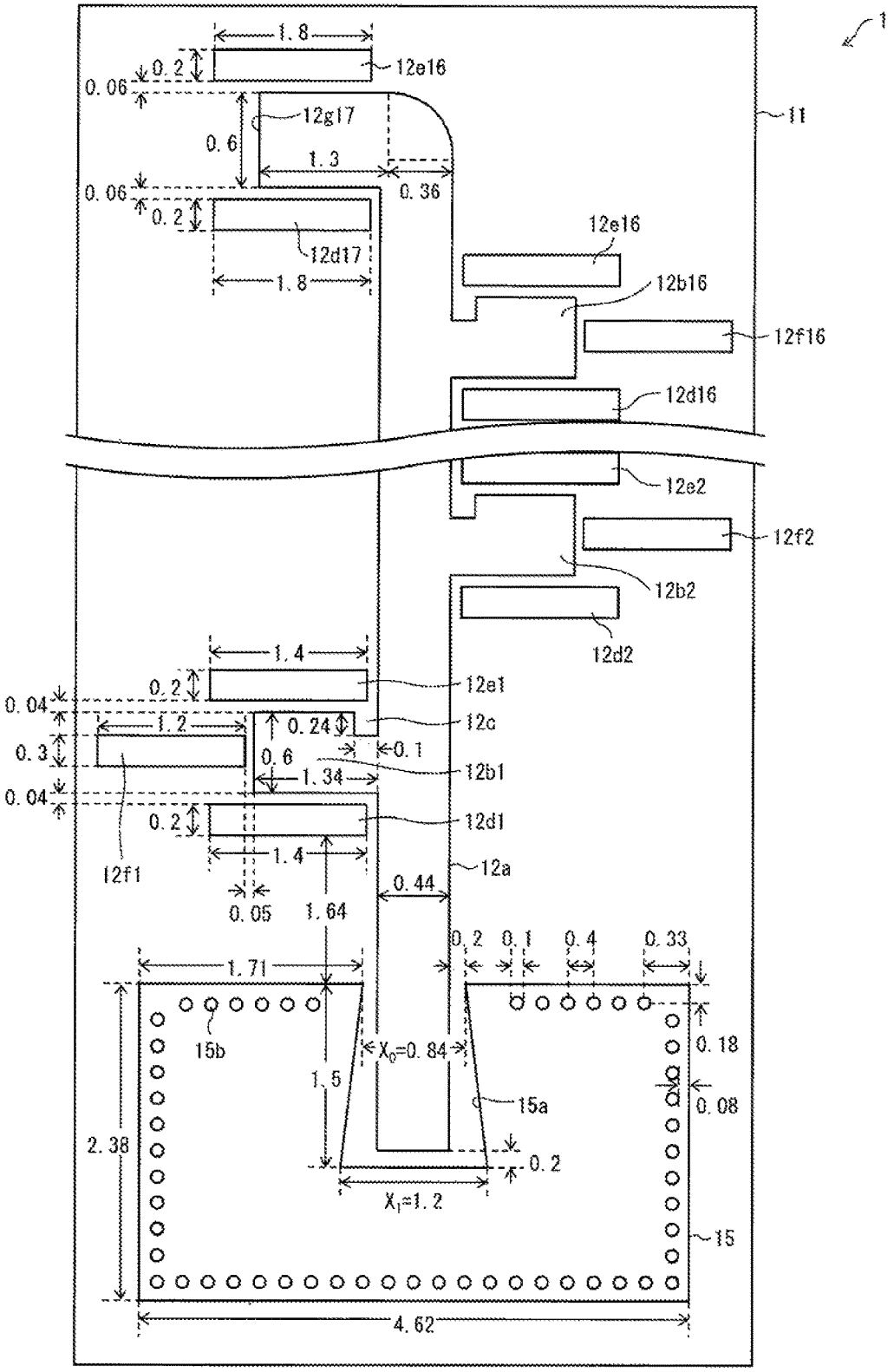
FIG. 3 is a plan view of an antenna in accordance with an Example, the plan view showing sizes of sections of the antenna.
Figure 4:
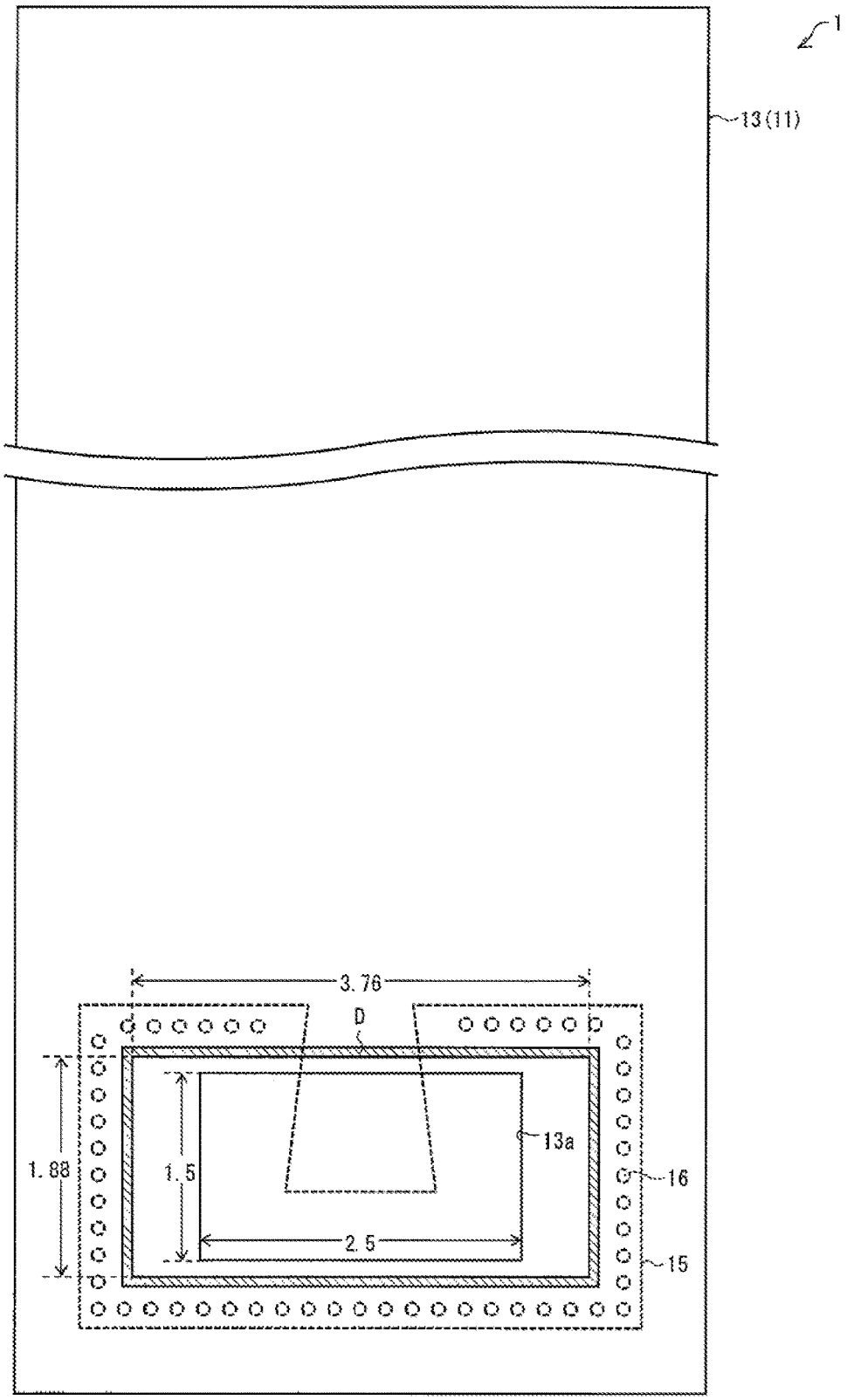
FIG. 4 is a bottom view of the antenna in accordance with the Example, the bottom view showing sizes of sections of the antenna.

The antenna 1 in accordance with the present Example is obtained by attaching the waveguide 14, the shield 15, and the short-circuit parts 16 to a microstrip antenna (constituted by the dielectric substrate 11, the antenna conductor 12, and the ground conductor 13) that operates at 60 GHz. Specifically, the antenna 1 in accordance with the present Example is obtained by setting sections of the antenna 1 illustrated in FIG. 1 to have sizes as shown in FIGS. 3 and 4. Note here that a microstrip antenna that operates at 60 GHz means a microstrip antenna that has a design center frequency of 60 GHz.

FIG. 3 is a plan view of the antenna 1 in accordance with the present Example, the plan view showing sizes (unit: mm) of sections of the antenna 1. FIG. 4 is a bottom view of the antenna 1 in accordance with the present Example, the bottom view showing sizes (unit: mm) of sections of the antenna 1. The antenna 1 in accordance with the present Example is arranged such that the dielectric substrate 11 has a thickness of 0.175 mm. Further, the antenna 1 in accordance with the present Example is arranged such that the dielectric substrate 11 has a specific inductive capacity of 3.0 and a dielectric dissipation factor of 0.0025.

(a) of FIG. 5 is a graph showing a reflection characteristic (frequency dependence of a reflection coefficient |S11|) of the antenna 1 in accordance with the present Example. (b) of FIG. 5 is graphs each showing a radiation characteristic (directional dependence of a gain on each of a y-z plane and a z-x plane) of the antenna 1 at 60 GHz.

It is confirmed from (a) of FIG. 5 that the reflection coefficient |S11| at 60 GHz has a value of approximately −18 dB, which falls below a design target value of −10 dB. It is also confirmed that a width of a band in which the reflection coefficient |S11| falls below −10 dB is approximately 3 GHz.

It is confirmed from (b) of FIG. 5 (1) that a maximum gain is 12.0 dBi, which exceeds a design target value of 10 dBi and (2) that a side lobe level is 11 dBi, which exceeds a design target value of 10 dBi.

[Influence of Omission of Parasitic Elements on Characteristics]

The following description discusses, with reference to FIGS. 6 and 7, an influence of omission of a part or all of the parasitic elements (the first parasitic element 12*d*, the second parasitic element 12*e*, and the third parasitic element 12*f*) on a reflection characteristic and a radiation characteristic of the antenna 1 in accordance with the present Example.

(a) of FIG. 6 is a plan view of the antenna 1 in accordance with the present Example. (b) through (d) of FIG. 6 are plan views of antennas in accordance with Comparative Examples. The following description compares characteristics of a group of antennas listed below. Note that the following description of (a) through (d) of FIG. 6 is given by taking, as an example, the stub 12*b*2, the first parasitic element 12*d*2, the second parasitic element 12*e*2, and the third parasitic element 12*f*2, which are an antenna element that comes second from the input end of the power feeding line 12*a*. An antenna element that comes first from the input end and antenna elements that comes third to sixteenth from the input end are similar in arrangement of the antenna element that comes second from the input end. In each of the antennas illustrated in (a) through (d) of FIG. 6, an antenna element provided at the terminal end of the power feeding line 12*a* includes the stub 12*g*17, the fourth parasitic element 12*d*17, and the fifth parasitic element 12*e*17 as illustrated in FIG. 3.

An antenna A is the antenna 1 in accordance with the present Example (see (a) of FIG. 6).

An antenna B is obtained by omitting the first parasitic element 12*d*2, the second parasitic element 12*e*2, and the third parasitic element 12*f*2 in the antenna 1 in accordance with the present Example (see (b) of FIG. 6).

An antenna C is obtained by omitting the first parasitic element 12*d*2 and the second parasitic element 12*e*2 in the antenna 1 in accordance with the present Example (see (c) of FIG. 6).

An antenna D is obtained by omitting the third parasitic element 12*f*2 in the antenna 1 in accordance with the present Example (see (d) of FIG. 6).

FIG. 7 is graphs showing respective reflection characteristics of the antennas A through D. A comparison of the respective reflection characteristics of the antennas A through D in FIG. 7 reveals that only the antenna A (the antenna 1 in accordance with the present Example) and the antenna D each have, at 60 GHz, the reflection coefficient |S11| whose value falls below a design target value of −10 dB. Thus, in order to obtain an excellent reflection characteristic at 60 GHz, an antenna preferably includes the first parasitic element 12*dl* and the second parasitic element 12*e*1 as in the antenna 1 in accordance with the present Example and the antenna D in accordance with a modification.

Further, it is confirmed that a band in which the antenna A has the reflection coefficient |S11| which falls below −10 dB is broader than a band in which the antenna D has the reflection coefficient |S11| which falls below −10 dB. Thus, in order to allow the operation band of the antenna 1 to be broader, an antenna more preferably includes not only the first parasitic element 12*dl* and the second parasitic element 12*e*1 but also the third parasitic element 12*f*2 as in the antenna 1 in accordance with the present Example 1.

[Influence of Sizes of First Parasitic Element and Second Parasitic Element on Characteristics]

The following description discusses, with reference to FIGS. 8 through 14, an influence of sizes of the first parasitic element 12*d* and the second parasitic element 12*e* on characteristics of the antenna 1 in accordance with the present Example. In the following description, the size of the first parasitic element 12*d* is defined as shown in FIG. 8. Specifically, a length lp1 refers to a length, extending in the x-axis direction, of the first parasitic element 12*d*, a width wp1 refers to a length, extending in the y-axis direction, of the first parasitic element 12*d*, and a gap gap1 refers to a gap between the stub 12*b* and the first parasitic element 12*d*.

According to the present Example, the shape of the first parasitic element 12*d* and the shape of the second parasitic element 12*e* are congruent with each other, and a gap between the stub 12*b* and the second parasitic element 12*e* is equal to the gap gap1.

(a) of FIG. 9 is graphs each showing a reflection characteristic of the antenna 1, the graphs being obtained in a case where a normalized width wp1/λ obtained by normalizing the width wp1 by a resonant wavelength λ (in the present Example, 5 mm) of a microstrip antenna is changed from 0.04 to 0.2 in increments of 0.04. (b) of FIG. 9 is graphs each showing a radiation characteristic, obtained on the y-z plane at 60 GHz, of the antenna 1.

(a) of FIG. 10 is a graph showing a fractional band width FBW of the antenna 1 and obtained in a case where the normalized width wp1/λ is changed from 0.04 to 0.2 in increments of 0.04. (b) of FIG. 10 is a graph showing a maximum gain of the antenna 1. Note here that the fractional band width FBW means a ratio of a width of a band in which the reflection coefficient |S11| falls below −10 dB to the design center frequency of 60 GHz.

FIGS. 9 and 10 reveal that in a case where the normalized width wp1/λ is not less than 0.04 and not more than 0.2, the antenna 1 exhibits a reflection characteristic of having the reflection coefficient |S11| which is not more than −10 dB in the operation band, and exhibits a radiation characteristic of having the maximum gain which is not less than 10 dBi at 60 GHz. Given that the fractional band width FBW exceeds 5% and the maximum gain exceeds 12 dBi, the normalized width wp1/λ can be said to have an optimum value of 0.04.

(a) of FIG. 11 is graphs each showing a reflection characteristic of the antenna 1, the graphs being obtained in a case where a normalized length lp1/λ obtained by normalizing the length lp1 by the resonant wavelength λ of the microstrip antenna is changed from 0.08 to 0.4 in increments of 0.04. (b) of FIG. 11 is graphs each showing a radiation characteristic, obtained on the y-z plane at 60 GHz, of the antenna 1.

(a) of FIG. 12 is a graph showing the fractional band width FBW of the antenna 1 and obtained in a case where the normalized length lp1/λ is changed from 0.08 to 0.4 in increments of 0.04. (b) of FIG. 12 is a graph showing the maximum gain of the antenna 1.

FIGS. 11 and 12 reveal that in a case where the normalized length lp1/λ is not less than 0.08 and less than 0.3, the antenna 1 exhibits a reflection characteristic of having the reflection coefficient |S11| which is not more than −10 dB in the operation band, and exhibits a radiation characteristic of having the maximum gain which is not less than 10 dBi at 60 GHz. Given that the fractional band width FBW reaches a maximum value and the maximum gain reaches a value close to the maximum value, the normalized length lp1/λ can be said to have an optimum value of 0.28.

(a) of FIG. 13 is graphs each showing a reflection characteristic of the antenna 1, the graphs being obtained in a case where a normalized gap gap1/λ obtained by normalizing the gap gap1 by the resonant wavelength λ of the microstrip antenna is changed from 0.004 to 0.02 in increments of 0.004. (b) of FIG. 13 is graphs each showing a radiation characteristic, obtained on the y-z plane at 60 GHz, of the antenna 1.

(a) of FIG. 14 is a graph showing the fractional band width FBW of the antenna 1 and obtained in a case where the normalized gap gap1/λ is changed from 0.004 to 0.02 in increments of 0.004. (b) of FIG. 14 is a graph showing the maximum gain of the antenna 1.

FIGS. 13 and 14 reveal that in a case where the normalized gap gap1/λ is not less than 0.004 and not more than 0.02, the antenna 1 exhibits a reflection characteristic of having the reflection coefficient |S11| which is not more than −10 dB in the operation band, and exhibits a radiation characteristic of having the maximum gain which is not less than 10 dBi at 60 GHz.

Further, FIGS. 13 and 14 also reveal that the fractional band width FBW exceeds 5% in a case where the normalized gap gap1/λ is not less than 0.004 and not more than 0.008. As a result of comparison between the normalized gap gap1/λ which is 0.004 and the normalized gap gap1/λ which is 0.008, the normalized gap gap1/λ which is 0.008 is more preferable. This is because the reflection characteristic has a peak near 60 GHz, and the peak has a simple shape. In view of the above description, the normalized gap gap1/λ can be said to have an optimum value of 0.008.

[Influence of Size of Third Parasitic Element on Characteristics]

The following description discusses, with reference to FIGS. 15 through 21, an influence of a size of the third parasitic element 12*f* on characteristics of the antenna 1 in accordance with the present Example. In the following description, the size of the third parasitic element 12*f* is defined as shown in FIG. 15. Specifically, a length lp2 refers to a length, extending in the x-axis direction, of the third parasitic element 12*f*, a width wp2 refers to a length, extending in the y-axis direction, of the third parasitic element 12*f*, and a gap gap2 refers to a gap between the stub 12*b* and the third parasitic element 12*f*.

(a) of FIG. 16 is graphs each showing a reflection characteristic of the antenna 1, the graphs being obtained in a case where a normalized width wp2/λ obtained by normalizing the width wp2 by the resonant wavelength λ of the microstrip antenna is changed from 0.02 to 0.1 in increments of 0.02. (b) of FIG. 16 is graphs each showing a radiation characteristic, obtained on the y-z plane at 60 GHz, of the antenna 1.

(a) of FIG. 17 is a graph showing the fractional band width FBW of the antenna 1 and obtained in a case where the normalized width wp2/λ is changed from 0.02 to 0.1 in increments of 0.02. (b) of FIG. 17 is a graph showing the maximum gain of the antenna 1.

FIGS. 16 and 17 reveal that in a case where the normalized width wp2/λ is not less than 0.02 and not more than 0.08, the antenna 1 exhibits a reflection characteristic of having the reflection coefficient |S11| which is not more than −10 dB in the operation band, and exhibits a radiation characteristic of having the maximum gain which is not less than 10 dBi at 60 GHz. Given that the fractional band width FBW exceeds 5%, the normalized width wp2/λ is more preferably not less than 0.03 and not more than 0.06. Further, given that a band in which the reflection coefficient

|S11| falls below −15 dB is broad, the normalized width wp2/λ can be said to have an optimum value of 0.06.

(a) of FIG. 18 is graphs each showing a reflection characteristic of the antenna 1, the graphs being obtained in a case where a normalized length lp2/λ obtained by normalizing the length lp2 by the resonant wavelength λ of the microstrip antenna is changed from 0.16 to 0.4 in increments of 0.04. (b) of FIG. 18 is graphs each showing a radiation characteristic, obtained on the y-z plane at 60 GHz, of the antenna 1.

(a) of FIG. 19 is a graph showing the fractional band width FBW of the antenna 1 and obtained in a case where the normalized length lp2/λ is changed from 0.16 to 0.4 in increments of 0.04. (b) of FIG. 19 is a graph showing the maximum gain of the antenna 1.

FIGS. 18 and 19 reveal that in a case where the normalized length lp2/λ is 0.28, the antenna 1 exhibits a radiation characteristic of having the maximum gain which falls below 10 dBi at 60 GHz. In other words, FIGS. 18 and 19 reveal that in a case where the normalized length lp2/λ is not less than 0.16 and not more than 0.24, and not less than 0.32 and not more than 0.4, the antenna 1 exhibits a reflection characteristic of having the reflection coefficient |S11| which is not more than −10 dB in the operation band, and exhibits a radiation characteristic of having the maximum gain which is not less than 10 dBi at 60 GHz.

From the viewpoint that the fractional band width FBW exceeds 4%, the maximum gain exceeds 12 dBi, and the antenna 1 is made smaller and integrated, the normalized length lp2/λ is preferably not less than 0.16 and not more than 0.24. Further, given that the fractional band width FBW exceeds 5%, the normalized length lp2/λ is more preferably not less than 0.2 and not more than 0.24.

As a result of comparison between the normalized length lp2/λ which is 0.2 and the normalized length lp2/λ which is 0.24, the normalized length lp2/λ which is 0.2 and the normalized length lp2/λ which is 0.24 are nearly equal in maximum gain, whereas the normalized length lp2/λ which is 0.24 is greater in fractional band width FBW than the normalized length lp2/λ which is 0.2. Thus, the normalized length lp2/λ can be said to have an optimum value of 0.24.

(a) of FIG. 20 is graphs each showing a reflection characteristic of the antenna 1, the graphs being obtained in a case where a normalized gap gap2/λ obtained by normalizing the gap gap2 by the resonant wavelength λ of the microstrip antenna is changed from 0.004 to 0.02 in increments of 0.004. (b) of FIG. 20 is graphs each showing a radiation characteristic, obtained on the y-z plane at 60 GHz, of the antenna 1.

(a) of FIG. 21 is a graph showing the fractional band width FBW of the antenna 1 and obtained in a case where the normalized gap gap2/λ is changed from 0.004 to 0.02 in increments of 0.004. (b) of FIG. 21 is a graph showing the maximum gain of the antenna 1.

FIGS. 20 and 21 reveal that in a case where the normalized length lp2/λ is in a range of not less than 0.004 and not more than 0.02, the antenna 1 exhibits a reflection characteristic of having the reflection coefficient |S11| which is not more than −10 dB in the operation band, and exhibits a radiation characteristic of having the maximum gain which is not less than 10 dBi at 60 GHz.

Further, FIGS. 20 and 21 also reveal that the fractional band width FBW exceeds 5% in a case where the normalized gap gap2/λ is not less than 0.004 and less than 0.012. Thus, the normalized gap gap2/λ is more preferably not less than 0.004 and less than 0.012. In FIG. 20, the normalized gap gap2/λ has an optimum value of 0.008.

[Influence on Characteristics of Width of Stub Provided at Terminal End]

The following description discusses, with reference to FIGS. 22 through 24, an influence of a width of the stub **12*g*17 on characteristics of the antenna 1 in accordance with the present Example. The stub 12*g*17 is provided at the terminal end of the power feeding line 12*a*. In the following description, the width of the stub 12*g*17 is defined as shown in (a) of FIG. 22. Specifically, a width wpt refers to a length, extending in the y-axis direction, of the stub 12*g*17**.

(a) of FIG. 23 is graphs each showing a reflection characteristic of the antenna 1, the graphs being obtained in a case where a normalized width wpt/λ obtained by normalizing the width wpt by the resonant wavelength λ of the microstrip antenna is changed from 0.04 to 0.2 in increments of 0.04. (b) of FIG. 23 is graphs each showing a radiation characteristic, obtained on the y-z plane at 60 GHz, of the antenna 1.

(a) of FIG. 24 is a graph showing the fractional band width FBW of the antenna 1 and obtained in a case where the normalized width wpt λ is changed from 0.04 to 0.2 in increments of 0.04. (b) of FIG. 24 is a graph showing the maximum gain of the antenna 1.

FIGS. 23 and 24 reveal that in a case where the normalized width wpt/λ is not less than 0.4 and not more than 0.2, the antenna 1 exhibits a reflection characteristic of having the reflection coefficient |S11| which is not more than −10 dB in the operation band, and exhibits a radiation characteristic of having the maximum gain which is not less than 10 dBi at 60 GHz. Given that the fractional band width FBW exceeds 5%, the normalized width wpt/λ is more preferably not less than 0.08 and not more than 0.16.

[Influence of Sizes of Fourth Parasitic Element and Fifth Parasitic Element on Characteristics]

The following description discusses, with reference to FIGS. 22 and 25 through 28, an influence of sizes of the fourth parasitic element **12*d*17 and the fifth parasitic element 12*e*17 on characteristics of the antenna 1 in accordance with the present Example. In the following description, the size of the fourth parasitic element 12*d*17 is defined as shown in FIG. (a) of FIG. 22. Specifically, a length lpt refers to a length, extending in the x-axis direction, of the fourth parasitic element 12*d* 17, and a gap gapt refers to a gap between the stub 12*g*17 and the fourth parasitic element 12*d*17**.

According to the present Example, the shape of the fourth parasitic element **12*d*17 and the shape of the fifth parasitic element 12*e*17 are congruent with each other, and a gap between the stub 12*g*17 and the fifth parasitic element 12*e*17** is equal to the gap gapt.

(a) of FIG. 25 is graphs each showing a reflection characteristic of the antenna 1, the graphs being obtained in a case where a normalized length lpt/λ obtained by normalizing the length lpt by the resonant wavelength λ of the microstrip antenna is changed from 0.2 to 0.36 in increments of 0.04. (b) of FIG. 25 is graphs each showing a radiation characteristic, obtained on the y-z plane at 60 GHz, of the antenna 1.

(a) of FIG. 26 is a graph showing the fractional band width FBW of the antenna 1 and obtained in a case where the normalized length lpt/λ is changed from 0.2 to 0.4 in increments of 0.04. (b) of FIG. 26 is a graph showing the maximum gain of the antenna 1.

FIGS. 25 and 26 reveal that in a case where the normalized length lpt/λ is not less than 0.2 and not more than 0.4, the antenna 1 exhibits a reflection characteristic of having the reflection coefficient |S11| which is not more than −10 dB in the operation band, and exhibits a radiation characteristic of having the maximum gain which is not less than 10 dBi at 60 GHz. Given that the fractional band width FBW exceeds 5% and the maximum gain exceeds 12 dBi, the normalized length lpt/λ is preferably not less than 0.32 and not more than 0.4. In FIG. 25, given that the fractional band width FBW has a maximum value, the normalized length lpt/λ is 0.36.

(a) of FIG. 27 is graphs each showing a reflection characteristic of the antenna 1, the graphs being obtained in a case where a normalized gap gapt/λ obtained by normalizing the gap gapt by the resonant wavelength λ of the microstrip antenna is changed from 0.004 to 0.02 in increments of 0.004. (b) of FIG. 27 is graphs each showing a radiation characteristic, obtained on the y-z plane at 60 GHz, of the antenna 1.

(a) of FIG. 28 is a graph showing the fractional band width FBW of the antenna 1 and obtained in a case where the normalized gap gapt/λ is changed from 0.004 to 0.02 in increments of 0.004. (b) of FIG. 28 is a graph showing the maximum gain of the antenna 1.

FIGS. 27 and 28 reveal that in a case where the normalized gap gapt/λ is not less than 0.004 and not more than 0.02, the antenna 1 exhibits a reflection characteristic of having the reflection coefficient |S11| which is not more than −10 dB in the operation band, and exhibits a radiation characteristic of having the maximum gain which is not less than 10 dBi at 60 GHz.

Further, FIGS. 27 and 28 also reveal that the fractional band width FBW exceeds 5% in a case where the normalized gap gapt/λ is not less than 0.004 and not more than 0.016.

[Influence of Presence or Absence of Parasitic Elements on Characteristics]

The following description discusses, with reference to FIGS. 22 and 29, an influence of omission of the fourth parasitic element 12*d*17 and the fifth parasitic element 12*e*17 or addition of a sixth parasitic element 12*f* 17 on characteristics of the antenna 1 in accordance with the present Example.

(a) of FIG. 22 is a plan view of the antenna 1 in accordance with the present Example. (b) and (c) of FIG. 22 are plan views of antennas in accordance with Comparative Examples. The following description compares characteristics of a group of antennas listed below. Note that in each of the antennas illustrated in (a) through (c) of FIG. 22, the antenna element provided between the input end and the terminal end of the power feeding line 12*a* includes the stub 12*b*, the first parasitic element 12*d*, the second parasitic element 12*e*, and the third parasitic element 12*f*.

An antenna E is the antenna 1 in accordance with the present Example (see (a) of FIG. 22).

An antenna F is obtained by omitting the fourth parasitic element 12*d*17 and fifth parasitic element 12*e*17 in the antenna 1 in accordance with the present Example (see (b) of FIG. 22).

An antenna G is obtained by newly adding the sixth parasitic element 12*f*17 in the antenna 1 in accordance with the present Example (see (c) of FIG. 22).

(a) of FIG. 29 is graphs showing respective reflection characteristics of the antennas E through G. (b) of FIG. 29 is graphs each showing respective radiation characteristics, obtained on the y-z plane, of the antennas E through G. (a) and (b) of FIG. 29 reveal that the antennas E through G each exhibit a reflection characteristic of having the reflection coefficient |S11| which is not more than −10 dB in the operation band, and exhibits a radiation characteristic of having the maximum gain which is not less than 10 dBi at 60 GHz.

In a case where attention is paid to a width of a band in which the reflection coefficient |S11| is not more than −10 dB, it is revealed that the antennas E through G have respective band widths that are nearly equal to each other, and the antenna E has the greatest band width. Meanwhile, in a case where attention is paid to a width of a band in which the gain is not less than 10 dBi, it is revealed that the antenna E has the greatest band width. In view of the above, it is revealed that the antenna E is most optimally arranged of the antennas E through G. Specifically, the antenna 1 in accordance with the present Example which antenna 1 is arranged to include the fourth parasitic element 12*d*17 and the fifth parasitic element 12*e*17 is preferable.

[Conclusion]

In order to attain the object, a microstrip antenna in accordance with the present embodiment includes: a dielectric substrate; a comb-line antenna conductor provided on a front surface of the dielectric substrate and including: a power feeding line that extends in a first direction; and a stub that extends from the power feeding line in a second direction orthogonal to the first direction; a ground conductor provided on a back surface of the dielectric substrate; a first parasitic element provided on the front surface of the dielectric substrate and facing a first side of the stub which first side is on a side of a direction opposite to the first direction; and a second parasitic element provided on the front surface of the dielectric substrate and facing a second side of the stub which second side is on the first direction side.

According to the arrangement, functions of the first parasitic element and the second parasitic element make it possible to expand a width of a band in which an ever-more-excellent reflection characteristic and an ever-more-excellent radiation characteristic are exhibited.

The microstrip antenna in accordance with the present embodiment is preferably arranged to further include: a third parasitic element provided on the front surface of the dielectric substrate and facing a third side of the stub which third side is on the second direction side.

The arrangement makes it possible to further expand a width of a band in which an ever-more-excellent reflection characteristic and an ever-more-excellent radiation characteristic are exhibited.

The antenna in accordance with the present embodiment is preferably arranged such that the stub has a root provided with a slit that extends from the second side in a direction opposite to the first direction.

The arrangement makes it possible to obtain a more excellent reflection characteristic and a more excellent radiation characteristic.

The antenna in accordance with the present embodiment is preferably arranged to further include: a waveguide joined to the back surface of the dielectric substrate and having: a tube axis orthogonal to the back surface of the dielectric substrate; and a tube wall whose end surface surrounds an opening provided in the ground conductor; a shield provided on the front surface of the dielectric substrate and provided with a slit in which to provide an input end of the power feeding line; and short-circuit parts via which the ground conductor and the shield are to be short-circuited and which are through the dielectric substrate, the short-circuit parts being provided around an entire outer circumference of the shield except for a place where the slit is provided, and the slit having a reverse taper shape that has a greater width in an inner part of the slit.

The arrangement makes it possible to obtain a more excellent reflection characteristic and a more excellent radiation characteristic.

The antenna in accordance with the present embodiment is preferably arranged such that: the first parasitic element has a length that extends in the first direction and is equal to a length, extending in the first direction, of the second parasitic element; and wp1/λ is not less than 0.04 and not more than 0.2 where wp1 is the length, extending in the first direction, of the first parasitic element and λ is a resonant wavelength of the microstrip antenna.

The antenna in accordance with the present embodiment is preferably arranged such that: the first parasitic element has a length that extends in the second direction and is equal to a length, extending in the second direction, of the second parasitic element; and lp1/λ is not less than 0.08 and less than 0.3 where lp1 is the length, extending in the second direction, of the first parasitic element and λ is a resonant wavelength of the microstrip antenna.

The antenna in accordance with the present embodiment is preferably arranged such that: a gap between the stub and the first parasitic element and a gap between the stub and the second parasitic element are equal to each other; and gap1/λ is not less than 0.004 and not more than 0.02 where gap1 is the gap between the stub and the first parasitic element and λ is a resonant wavelength of the microstrip antenna.

The antenna in accordance with the present embodiment is preferably arranged such that wp2/λ is not less than 0.02 and not more than 0.08 where wp2 is a length, extending in the first direction, of the third parasitic element and λ is a resonant wavelength of the microstrip antenna.

The antenna in accordance with the present embodiment is preferably arranged such that lp2/λ is not less than 0.16 and not more than 0.24, or not less than 0.32 and not more than 0.4 where lp2 is a length, extending in the second direction, of the third parasitic element and λ is a resonant wavelength of the microstrip antenna.

The antenna in accordance with the present embodiment is preferably arranged such that gap2/λ is not less than 0.004 and not more than 0.02 where gap2 is a gap between the stub and the third parasitic element and A is a resonant wavelength of the microstrip antenna.

The arrangements each make it possible to further expand a width of a band in which an ever-more-excellent reflection characteristic and an ever-more-excellent radiation characteristic are exhibited.

[Additional Matter]

The present invention is not limited to the description of the embodiments (examples) above, but may be altered by a skilled person within the scope of the claims. An embodiment based on a proper combination of technical means disclosed in different embodiments is encompassed in the technical scope of the present invention.

INDUSTRIAL APPLICABILITY

The present invention can be suitably used as, for example, an antenna that operates in a millimeter wave band.

REFERENCE SIGNS LIST

1 Antenna
11 Dielectric substrate
12 Antenna conductor
12*a* Power feeding line
12*b*1-12*b*16 Stub
12*c* Slit
12*d*1-12*d*16 First parasitic element
12*e*1-12*e*16 Second parasitic element
12*f*1-12*f*16 Third parasitic element
12*d* 17 Fourth parasitic element
12*e*17 Fifth parasitic element
12*g*17 Stub
13 Ground conductor
13*a* Opening
14 Waveguide
14*a* Tube wall
14*b* Cavity
15 Shield
15*a* Slit
16 Short-circuit part

The invention claimed is:

1. A microstrip antenna comprising:
a dielectric substrate:
a comb-line antenna conductor provided on a front surface of the dielectric substrate and including: a power feeding line that extends in a first direction; and a stub that extends from the power feeding line in a second direction orthogonal to the first direction;
a ground conductor provided on a back surface of the dielectric substrate;
a first parasitic element provided on the front surface of the dielectric substrate and facing a first side of the stub which first side is on a side of a direction opposite to the first direction; and
a second parasitic element provided on the front surface of the dielectric substrate and facing a second side of the stub which second side is on the first direction side.

2. The microstrip antenna as set forth in claim 1, further comprising:
a third parasitic element provided on the front surface of the dielectric substrate and facing a third side of the stub which third side is on the second direction side.

3. The microstrip antenna as set forth in claim 1, wherein the stub has a root provided with a slit that extends from the second side in a direction opposite to the first direction.

4. The microstrip antenna as set forth in claim 1, further comprising:
a waveguide joined to the back surface of the dielectric substrate and having: a tube axis orthogonal to the back surface of the dielectric substrate; and a tube wall whose end surface surrounds an opening provided in the ground conductor;
a shield provided on the front surface of the dielectric substrate and provided with a slit in which to provide an input end of the power feeding line; and
short-circuit parts via which the ground conductor and the shield are to be short-circuited and which are through the dielectric substrate,
the short-circuit parts being provided around an entire outer circumference of the shield except for a place where the slit is provided, and the slit having a reverse taper shape that has a greater width in an inner part of the slit.

5. The microstrip antenna as set forth in claim 1, wherein:
the first parasitic element has a length that extends in the first direction and is equal to a length, extending in the first direction, of the second parasitic element; and
wp1/λ is not less than 0.04 and not more than 0.2 where wp1 is the length, extending in the first direction, of the first parasitic element and λ is a resonant wavelength of the microstrip antenna.

6. The microstrip antenna as set forth in claim 1, wherein:

the first parasitic element has a length that extends in the second direction and is equal to a length, extending in the second direction, of the second parasitic element; and lp1/λ is not less than 0.08 and less than 0.3 where lp1 is the length, extending in the second direction, of the first parasitic element and λ is a resonant wavelength of the microstrip antenna.

7. The microstrip antenna as set forth in claim 1, wherein:

a gap between the stub and the first parasitic element and a gap between the stub and the second parasitic element are equal to each other; and gap1/λ is not less than 0.004 and not more than 0.02 where gap1 is the gap between the stub and the first parasitic element and λ is a resonant wavelength of the microstrip antenna.

8. The microstrip antenna as set forth in claim 2, wherein wp2/λ is not less than 0.02 and not more than 0.08 where wp2 is a length, extending in the first direction, of the third parasitic element and λ is a resonant wavelength of the microstrip antenna.

9. The microstrip antenna as set forth in claim 2, wherein lp2/λ is not less than 0.16 and not more than 0.24, or not less than 0.32 and not more than 0.4 where lp2 is a length, extending in the second direction, of the third parasitic element and λ is a resonant wavelength of the microstrip antenna.

10. The microstrip antenna as set forth in claim 2, wherein gap2/λ is not less than 0.004 and not more than 0.02 where gap2 is a gap between the stub and the third parasitic element and λ is a resonant wavelength of the microstrip antenna.

* * * * *